US010569590B2

(12) United States Patent
Richied

(10) Patent No.: US 10,569,590 B2
(45) Date of Patent: Feb. 25, 2020

(54) BINDING SYSTEM FOR RETAINING BOUND COMPONENTS

(71) Applicant: ACCO Brands Corporation, Lake Zurich, IL (US)

(72) Inventor: Kenneth P. Richied, Cincinnati, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 15/784,564

(22) Filed: Oct. 16, 2017

(65) Prior Publication Data

US 2018/0037047 A1 Feb. 8, 2018

Related U.S. Application Data

(62) Division of application No. 13/552,359, filed on Jul. 18, 2012, now Pat. No. 9,862,221.

(60) Provisional application No. 61/616,096, filed on Mar. 27, 2012, provisional application No. 61/509,040, filed on Jul. 18, 2011.

(51) Int. Cl.
*B42D 1/00* (2006.01)
*B42B 5/12* (2006.01)

(52) U.S. Cl.
CPC ..... *B42D 1/00* (2013.01); *B42B 5/12* (2013.01); *B42B 5/123* (2013.01); *B42D 1/004* (2013.01)

(58) Field of Classification Search
CPC .. B42D 1/00; B42D 1/004; B42B 5/12; B42B 5/123
USPC ..... 402/5, 6, 20, 26, 31, 43, 44, 45, 46
See application file for complete search history.

(56) References Cited

U.S. PATENT DOCUMENTS

| | | | |
|---|---|---|---|
| 812,121 | A | 2/1906 | Edwards |
| 1,074,833 | A | 10/1913 | Browne |
| 1,516,932 | A | 11/1924 | Staab |
| 1,673,090 | A | 6/1928 | Real |
| 1,694,846 | A | 12/1928 | Diestelkamp |
| 1,995,590 | A | 3/1935 | Staab et al. |
| 2,050,545 | A | 8/1936 | Schade |
| 2,058,272 | A | 10/1936 | Taylor |
| 2,061,677 | A | 11/1936 | Schade |

(Continued)

FOREIGN PATENT DOCUMENTS

| | | |
|---|---|---|
| EP | 0095243 | 11/1983 |
| EP | 0095244 | 11/1983 |

(Continued)

OTHER PUBLICATIONS

PCT, International Search Report and Written Opinion, International Application No. PCT/US2012/047205 (dated May 3, 2013).

(Continued)

*Primary Examiner* — Justin V Lewis
(74) *Attorney, Agent, or Firm* — Fitch, Even, Tabin & Flannery LLP

(57) ABSTRACT

A binding apparatus including a plurality of generally coaxially arranged binding coils. Each binding coil includes a pair of generally parallel wires terminating in a tip. Each binding coil is coupled to an adjacent binding coil by a connection portion extending generally parallel to an axis of the binding apparatus. At least one binding coil is directly circumferentially attached to itself, or to a connection portion.

26 Claims, 29 Drawing Sheets

(56) References Cited

U.S. PATENT DOCUMENTS

| | | | | |
|---|---|---|---|---|
| 2,082,424 | A | | 6/1937 | Schade |
| 2,116,589 | A | | 5/1938 | Trussell |
| 2,132,542 | A | | 10/1938 | Schade |
| 2,136,878 | A | | 11/1938 | Grumbacher |
| 2,142,817 | A | | 1/1939 | Gudis |
| 2,144,581 | A | | 1/1939 | Trussell |
| 2,185,004 | A | | 12/1939 | Trussell |
| 2,193,348 | A | | 3/1940 | Schade |
| 2,262,601 | A | | 11/1941 | Brook |
| 2,264,142 | A | | 11/1941 | Penney et al. |
| 2,291,512 | A | | 7/1942 | Trussell |
| 2,321,560 | A | | 6/1943 | Trussell |
| 2,342,130 | A | | 2/1944 | Emmer |
| 2,364,890 | A | | 12/1944 | Cadwallader |
| 2,583,998 | A | | 1/1952 | Cook |
| 2,641,321 | A | | 6/1953 | Cruzan |
| 2,709,439 | A | | 5/1955 | Schade |
| 2,754,826 | A | | 7/1956 | Berberich |
| 2,764,162 | A | | 9/1956 | Valla |
| 3,252,461 | A | | 5/1966 | Schade |
| 3,407,105 | A | | 10/1968 | Staats et al. |
| 3,483,067 | A | | 12/1969 | Staats et al. |
| 3,526,415 | A | | 9/1970 | Freundlich |
| 3,568,729 | A | | 3/1971 | Freundlich et al. |
| 3,576,690 | A | | 4/1971 | Staats et al. |
| 3,623,514 | A | | 11/1971 | Pfaffle |
| 4,031,585 | A | | 6/1977 | Adams |
| 4,545,603 | A | * | 10/1985 | Henes ..... B42B 5/10 281/27.1 |
| 4,558,981 | A | | 12/1985 | Fabrig |
| 4,577,889 | A | | 3/1986 | Schulz |
| 4,773,787 | A | | 9/1988 | Chang |
| 4,811,973 | A | | 3/1989 | Kumar-Misir |
| 4,848,948 | A | | 7/1989 | Pitts |
| 4,934,890 | A | | 6/1990 | Flatt |
| 4,941,804 | A | | 7/1990 | Sarpy, Jr. |
| 4,943,177 | A | | 7/1990 | Jordan et al. |
| D313,315 | S | | 1/1991 | Prat |
| 5,037,229 | A | | 8/1991 | Stengel |
| D323,934 | S | | 2/1992 | Prat |
| D334,405 | S | | 3/1993 | Prat |
| 5,417,508 | A | * | 5/1995 | Friedman ..... B42B 5/12 402/19 |
| 5,417,510 | A | | 5/1995 | Stout |
| 5,419,586 | A | | 5/1995 | Golson |
| 5,445,467 | A | | 8/1995 | Peleman |
| 5,476,336 | A | | 12/1995 | Osiecki et al. |
| 5,509,746 | A | | 4/1996 | Ho |
| D373,599 | S | | 9/1996 | Bernard |
| 5,697,646 | A | | 12/1997 | Venegas |
| 5,816,730 | A | | 10/1998 | Alspaw et al. |
| 5,836,711 | A | | 11/1998 | Stewart |
| 5,941,289 | A | | 8/1999 | Fuchs |
| 6,059,504 | A | | 5/2000 | Ishida et al. |
| 6,079,924 | A | | 6/2000 | Chiang |
| 6,203,230 | B1 | | 3/2001 | Whang |
| 6,210,065 | B1 | | 4/2001 | Tower |
| 6,406,208 | B1 | | 6/2002 | Hsu |
| D463,487 | S | | 9/2002 | Savoy |
| 6,764,100 | B1 | | 7/2004 | Miro |
| 6,868,872 | B2 | | 3/2005 | Fuchs |
| 7,077,394 | B2 | | 7/2006 | Fuchs |
| 7,242,204 | B2 | | 7/2007 | Otaguro et al. |
| 7,708,513 | B2 | | 5/2010 | Fisher et al. |
| 2003/0031502 | A1 | | 2/2003 | Rothschild |
| 2003/0183298 | A1 | | 10/2003 | Fuchs |
| 2003/0198536 | A1 | | 10/2003 | Buhler et al. |
| 2004/0052615 | A1 | | 3/2004 | Fuchs et al. |
| 2004/0218996 | A1 | | 11/2004 | Fuchs |
| 2006/0043726 | A1 | | 3/2006 | Schamer |
| 2008/0298881 | A1 | | 12/2008 | Todaro et al. |
| 2009/0250918 | A1 | | 10/2009 | Seidl |
| 2009/0269166 | A1 | | 10/2009 | Richards |
| 2010/0109313 | A1 | | 5/2010 | Fuchs |
| 2010/0119334 | A1 | | 5/2010 | Fuchs |
| 2010/0316435 | A1 | | 12/2010 | Gilbert |
| 2010/0316436 | A1 | | 12/2010 | Fuchs |
| 2011/0033727 | A1 | | 2/2011 | Grob et al. |

FOREIGN PATENT DOCUMENTS

| | | |
|---|---|---|
| EP | 0095245 | 11/1983 |
| EP | 0239314 | 9/1987 |
| EP | 0322163 | 6/1989 |
| EP | 0334260 | 9/1989 |
| EP | 0450733 | 10/1991 |
| EP | 0529881 | 3/1993 |
| EP | 0825033 | 2/1998 |
| EP | 1031434 | 8/2000 |
| EP | 0886584 | 5/2001 |
| EP | 1348572 | 10/2003 |
| EP | 1348574 | 10/2003 |
| EP | 1378371 | 1/2004 |
| EP | 2177366 | 4/2010 |
| EP | 2177367 | 4/2010 |
| EP | 2253569 | 11/2010 |
| EP | 2261049 | 12/2010 |
| JP | 10-138678 | 5/1998 |
| JP | 2002-019363 | 1/2002 |
| JP | 2003-025781 | 1/2003 |
| JP | 2004-106438 | 4/2004 |
| JP | 2005037229 | 2/2005 |
| JP | 2005059563 | 3/2005 |
| JP | 5417508 | 2/2014 |
| WO | 97/33762 | 9/1997 |
| WO | 01/45960 | 6/2001 |
| WO | 01/68379 | 9/2001 |
| WO | 02/42090 | 5/2002 |
| WO | 02/55312 | 7/2002 |
| WO | 03/020533 | 3/2003 |
| WO | 2005/011996 | 2/2005 |
| WO | 2005/018949 | 3/2005 |
| WO | 2005/055312 | 6/2005 |
| WO | 2006/017255 | 2/2006 |
| WO | 2008/140318 | 11/2008 |
| WO | 2009/129979 | 10/2009 |
| WO | 2010/142360 | 12/2010 |

OTHER PUBLICATIONS

Double-O Wire, by Spiral of Canada, Inc., http://www.spiralofcanada.com (retrieved from the internet Feb. 16, 2011).

CN, Notification of the First Office Action, Chinese Application No. 201280041292.2 (dated Jan. 21, 2015).

Office Action issued in corresponding Canadian Application No. 2,842,250 dated Aug. 11, 2016.

Office Action issued in corresponding Canadian Application No. 2,842,250 dated May 24, 2017.

Office Action issued in corresponding Canadian Application No. 2,842,250 dated Mar. 2, 2018.

Office Action issued in corresponding Canadian Application No. 2,842,250 dated Dec. 6, 2018.

Office Action issued in corresponding Japanese Application No. 2014-521734 dated Jul. 27, 2016.

* cited by examiner

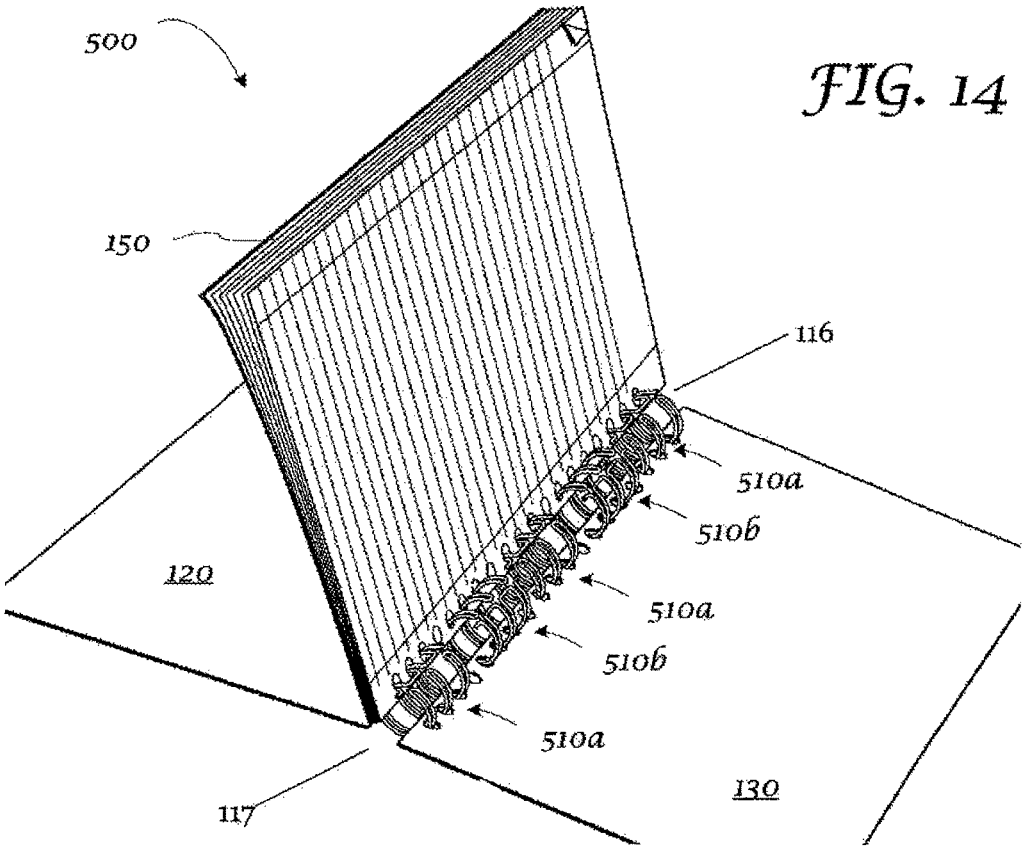
FIG. 14
FIG. 15
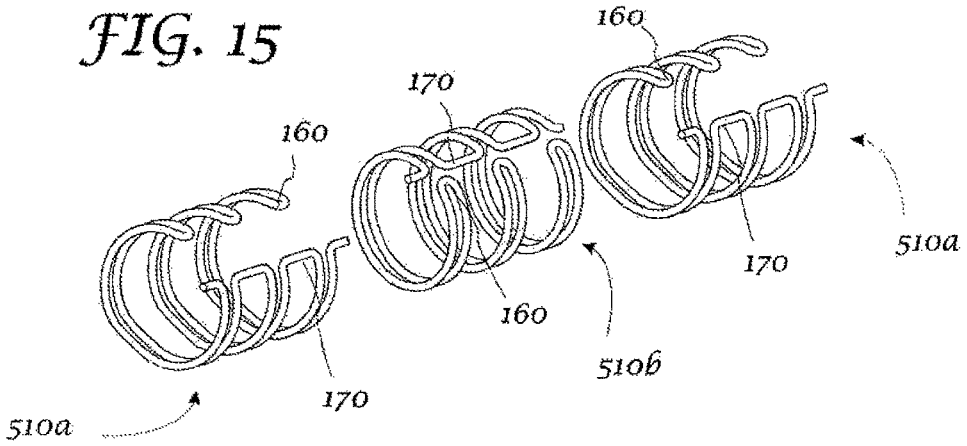

FIG. 16
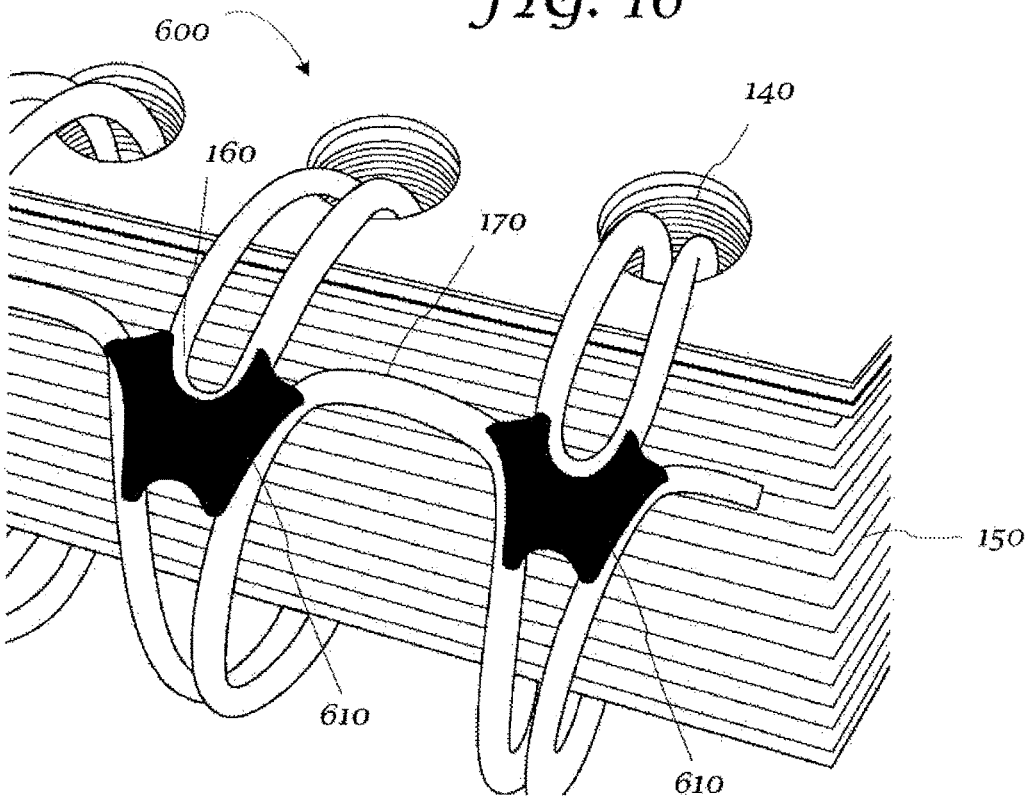
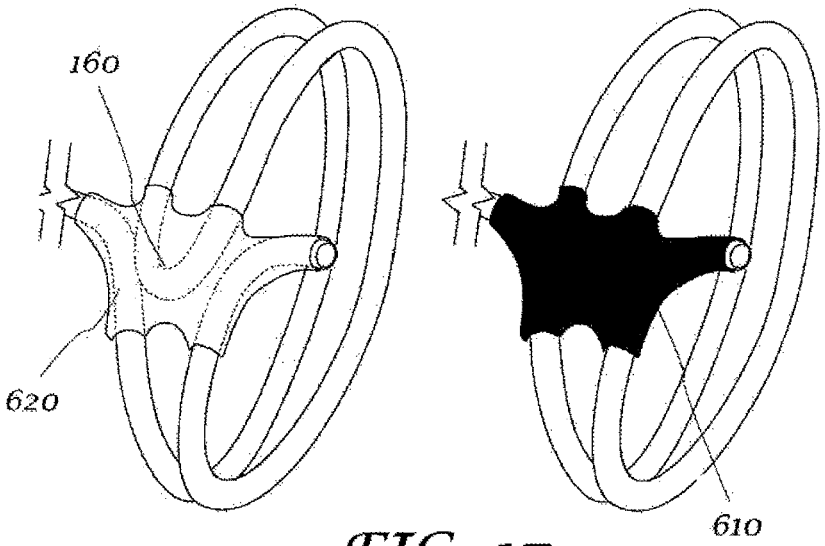
FIG. 17

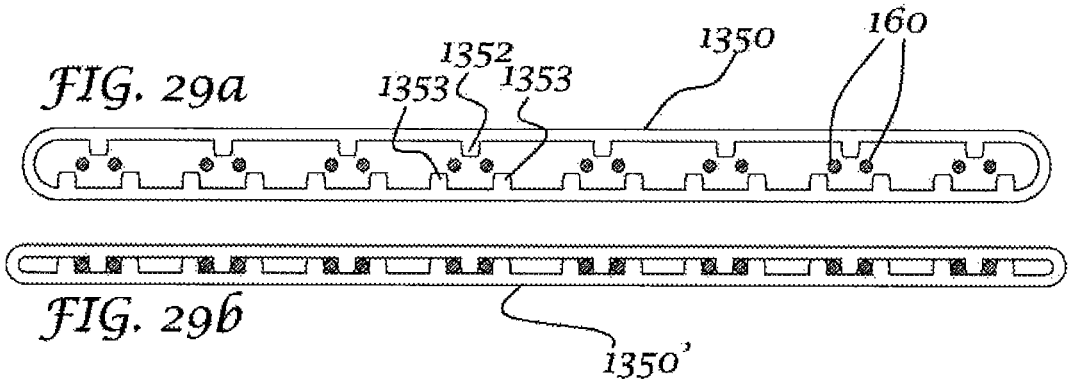
FIG. 29a
FIG. 29b
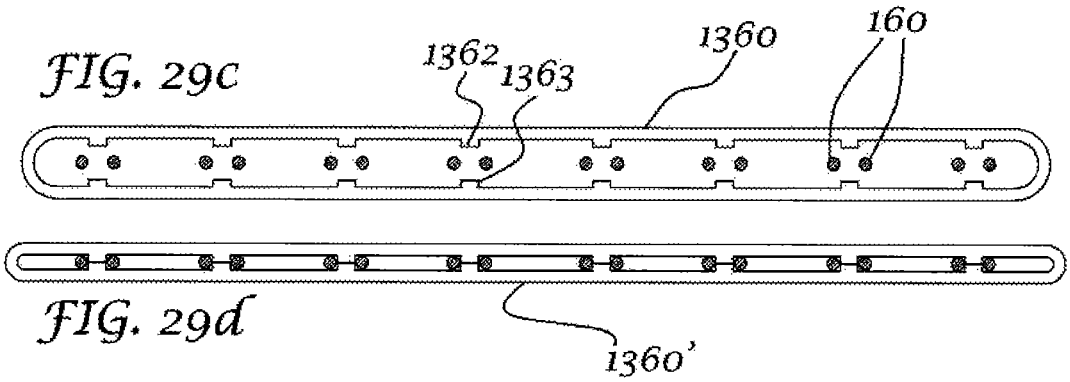
FIG. 29c
FIG. 29d
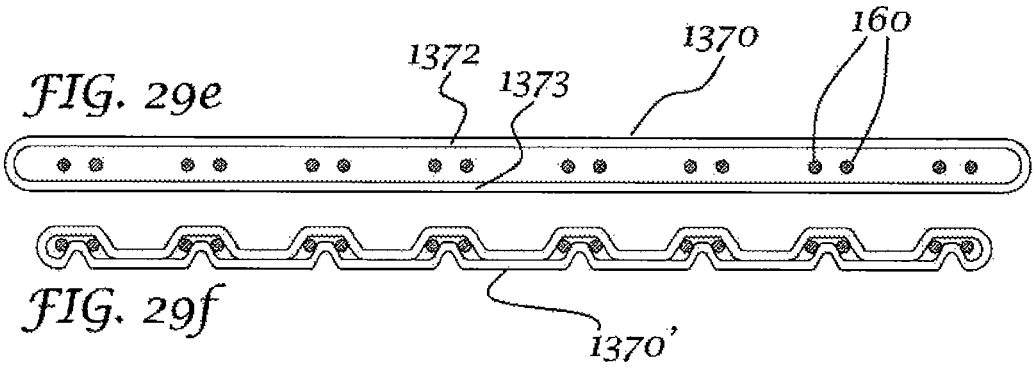
FIG. 29e
FIG. 29f FIG. 31a
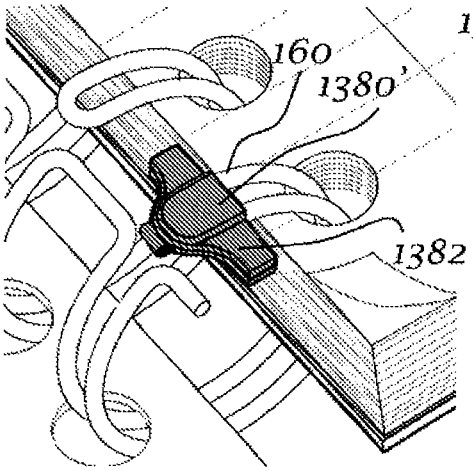
FIG. 31b
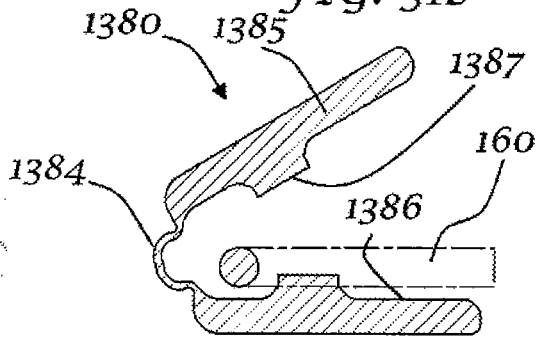
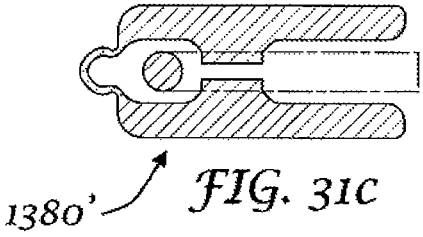
FIG. 31c
FIG. 31d
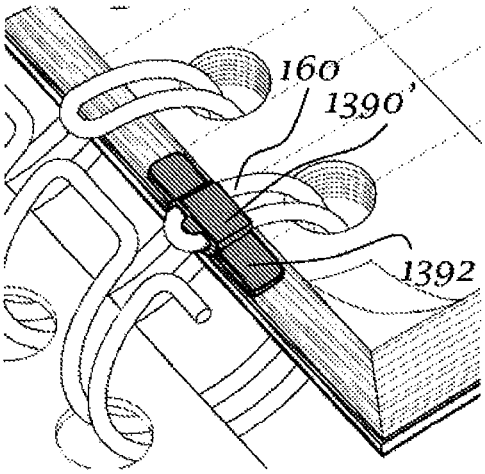
FIG. 31e
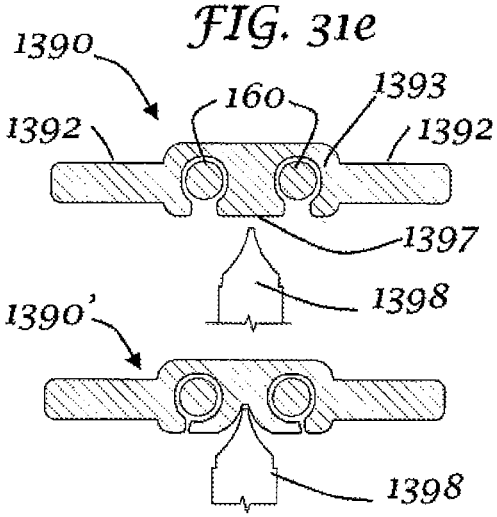
FIG. 31f 1460
160
150

1464

150
161
1466
1462
150
161

BINDING SYSTEM FOR RETAINING BOUND COMPONENTS

This application is a divisional of U.S. patent application Ser. No. 13/552,359, filed on Jul. 18, 2012 entitled BINDING SYSTEM FOR RETAINING BOUND COMPONENTS, now issued as U.S. Pat. No. 9,862,221, which in turn claims priority to U.S. Provisional Patent Application Ser. No. 61/616,096 filed on Mar. 27, 2012, and U.S. Provisional Patent Application Ser. No. 61/509,040 filed on Jul. 18, 2011. The entire contents of all three of these applications are incorporated by reference herein.

BACKGROUND

Wire binding mechanisms, including twin-wire binding mechanisms, are often used to bind together a plurality of items to form a notebook, notepad, or other bound components. However, some such wire binding mechanism may have gaps or openings therein which may allow paper or other bound components to escape from the binding mechanism.

SUMMARY

In one embodiment the present invention takes the form of a binding mechanism configured to prevent papers or other bound components from separating from the binding mechanism. In particular, in one embodiment the invention is an apparatus and/or method for locking a wire binding system, for example a twin-wire, spiral, or other binding device or mechanism, such that the bound contents such as paper, folders, covers or pocket dividers do not separate from the binding system.

In a first embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The ends of the twin-wire apparatus may be cut at a point in a joining section that leaves a length of wire that extends over the nearest opposing tip section. Each end may be bent inwards into a loop around the nearest opposing tip section and clamped back onto itself to form a closed loop link.

In a second embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The ends of the twin-wire apparatus may be cut at a point in a joining section that leaves a length of wire that is threaded through the nearest opposing tip section. The ends may be bent outwards into a loop around the nearest opposing tip section and clamped back onto itself to form a closed loop link.

In a third embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The ends of the twin-wire apparatus may be cut at a point in a joining section that leaves a length of wire that is threaded through the nearest opposing tip section. Each end may be bent sideways into a loop around the nearest opposing tip section and clamped back onto itself to form a closed loop link.

In a fourth embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The ends of the twin-wire apparatus may be cut at a point in a tip section that leaves a length of wire that is threaded through the nearest opposing joining section. Each end may be bent outwards into a loop around the nearest opposing tip section and clamped back onto itself to form a closed loop link.

In a fifth embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The ends of the twin-wire apparatus may be cut at a point in a tip section that leaves a length of wire that is extended over the nearest opposing joining section. Each end may be bent inwards into a loop around the nearest opposing tip section and clamped back onto itself to form a closed loop link.

In a sixth embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The locking apparatus further includes a coil spine joint comprised of a pair of joining hook sections opposed by a tip hook section disposed between the pair of joining hook sections all connected along a spine section. The pair of joining hook sections are adapted to cooperatively engage corresponding adjacent joining sections and the tip hook section is adapted to cooperatively engage a corresponding opposing tip section. The coil spine joint may be made from injection molded plastic or stamped metal among other materials.

In a seventh embodiment, the device is a coil spine joint for use with a twin-wire binding apparatus. The coil spine joint is comprised of a pair of joining hook sections opposed by a tip hook section disposed between the pair of joining hook sections all connected along a spine section. The pair of joining hook sections are adapted to cooperatively engage corresponding adjacent joining sections and the tip hook section is adapted to cooperatively engage a corresponding opposing tip section of a twin-wire binding apparatus. The coil spine joint may be made from injection molded plastic or stamped metal among other materials.

In an eighth embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The locking apparatus further includes a snap-in comb component comprised of a spine element and a plurality of finger elements each including a catch apparatus protruding substantially 90°, or some other angle, from the spine element. The finger elements may be generally arrow shaped and adapted to fit within the width of the tip sections such that once inserted through a tip section the wide trailing edge of the arrow shape acts as a catch apparatus to keep the finger element from dislodging.

In a ninth embodiment, the device is a snap-in comb component for use with a twin-wire binding apparatus. The snap-in comb component is comprised of a spine element and a plurality of finger elements each including a catch apparatus protruding substantially 90° from the spine element. The finger elements may be generally arrow shaped and adapted to fit within the width of the tip sections such that once inserted through a tip section the wide trailing edge of the arrow shape acts as a catch apparatus to keep the finger element from dislodging.

In a tenth embodiment, the device is a locking apparatus for a twin-wire binding apparatus. The locking apparatus includes a plurality of twin-wire apparatus segments comprising a continuous length of wire bent in a generally circular manner about a lengthwise axis to form opposing alternating generally u-shaped tip sections and joining sections. The joining sections may be of greater width than the tip sections. The segments may be oriented such that each segment is reverse oriented from its adjacent segment so that the tip sections of one segment point in a direction that is substantially 180° reversed from the tip sections in an adjacent segment. There may be any number of segments so long as there are at least two.

In an eleventh embodiment, the device is a locking apparatus for a twin-wire binding apparatus. The locking apparatus includes a twin-wire apparatus comprising a continuous length of wire bent in a generally circular manner about a lengthwise axis to form opposing alternating generally u-shaped tip sections and joining sections. The joining sections may be of greater width than the tip sections. The locking apparatus further includes a solder weld that couples together and closes a gap between a tip section and the space between adjacent opposing joining sections. The solder weld may be a metal solder, a plastic solder, or an adhesive material.

In a twelfth embodiment, the device is a locking apparatus for a spiral wire binding apparatus. The locking apparatus includes a continuous length of wire bent in a generally circular manner about a lengthwise axis to form successive coils. The spiral wire may be cut at a point that leaves a length of wire that extends past an adjacent coil and is bent into a loop around the adjacent coil and clamped back onto itself to form a closed loop link. The locking apparatus further includes a solder weld that couples together and closes a gap between the closed loop link and the adjacent coil. The solder weld may be a metal solder, a plastic solder, or an adhesive material. The adjacent coil may be the nearest coil.

In a thirteenth embodiment, the device is a locking apparatus for a twin-wire binding apparatus comprising. The locking apparatus includes a continuous length of wire bent in a generally circular manner about a lengthwise axis to form opposing alternating generally u-shaped tip sections and joining sections in which the joining sections are of greater width than the tip sections. A staple connects at least one tip section to at least one adjacent tip section or joining section. The staple may be formed from a metal or plastic wire that is formed or bent to shape. The staple may connect two tip sections, a tip section to one joining section, or a tip section to two joining sections.

In a fourteen embodiment the device is a locking apparatus for a twin-wire binding apparatus. The locking apparatus includes a continuous length of wire bent in a generally circular manner about a lengthwise axis to form opposing alternating generally u-shaped tip sections and joining sections in which the joining sections are of greater width than the tip sections, and a guardrail connecting at least a first tip section to at least a second adjacent tip section. The guardrail may have the form of a loop of material having a first longitudinal part and a second longitudinal part extending between the tip sections. At least one of the first and second longitudinal parts may have a finger or deformation extending between the first and second longitudinal parts, the finger or deformation being located proximate to one of said tip sections. The finger or deformation may be located between the two wires forming a single tip section.

In a fifteenth embodiment the device is a locking apparatus for a twin-wire binding apparatus. The locking apparatus may include a continuous length of wire bent in a generally circular manner about a lengthwise axis to form opposing alternating generally u-shaped tip sections and joining sections in which the joining sections are of greater width than the tip sections and a blocking device on at least one tip section, the blocking device having a wing section. The wing section may extend in the direction of the lengthwise axis. The blocking device may be attached to the tip section by a snap-action fit. The blocking device may be molded or cast onto the tip section. The blocking device may be heat-formed or pressure-formed onto the tip section.

In a sixteenth embodiment the device is a locking apparatus for a twin-wire binding apparatus. The locking apparatus may include a continuous length of wire bent in a generally circular manner about a lengthwise axis to form opposing alternating generally u-shaped tip sections and joining sections in which the joining sections are of greater width than the tip sections, and a washer lock attached to at least one of the tip sections. The washer lock may be a circular ring with at least one tooth. The circular ring may be bent upon itself to form an approximately semicircular shape with the tooth between the two wires forming the tip section to which the washer lock is attached. The circular ring may define a plane, and the ring may be compressed generally within said plane to bring the tooth between the two wires forming the tip section to which the washer lock is attached. The washer lock may include two circular sections joined together, and the washer lock may be attached to top adjacent tip sections. The washer lock may include a circular ring with two inward-facing teeth.

In a seventeenth embodiment the device is a locking apparatus for a twin-wire binding apparatus. The locking apparatus may include a continuous length of wire bent in a generally circular manner about a lengthwise axis to form opposing alternating generally u-shaped tip sections and joining sections in which the joining sections are of greater width than the tip sections, and one or more pages having holes to receive the tip sections, and the tip sections may include a content carrying portion sized to fit within the holes, and a terminal portion with a size larger than the holes. The terminal portions have the form of arrows or tees. The terminal portions may be formed after the pages have been placed on the tip sections. The terminal portions may be formed before the pages are placed on the tip sections, with the tip sections being flexible or compressible enough to pass through the holes. The terminal portions may be shaped to resist passing back through the holes once the pages have been placed on the tip sections.

BRIEF DESCRIPTION OF THE DRAWINGS

FIG. 14 is a perspective view of a segmented opposite closure embodiment for a twin-wire binding system according to an embodiment of the invention;

FIG. 15 is a perspective view of three successive segmented opposite closure twin-wire apparatuses;

FIG. 16 is an illustration of a solder lock embodiment for a twin-wire binding system according to an embodiment of the invention;

FIG. 17 is two illustrations of a solder lock covering a section of a twin-wire apparatus;

FIGS. 29*a-f* are cross sections illustrating "guard rail" type devices for locking together (along the binding axis) loops of a twin-wire binding apparatus;

FIGS. 31*a-f* are illustrations and cross sections of elements for attaching to the tips of loops of a twin-wire binding apparatus;

DETAILED DESCRIPTION

Figure 1:
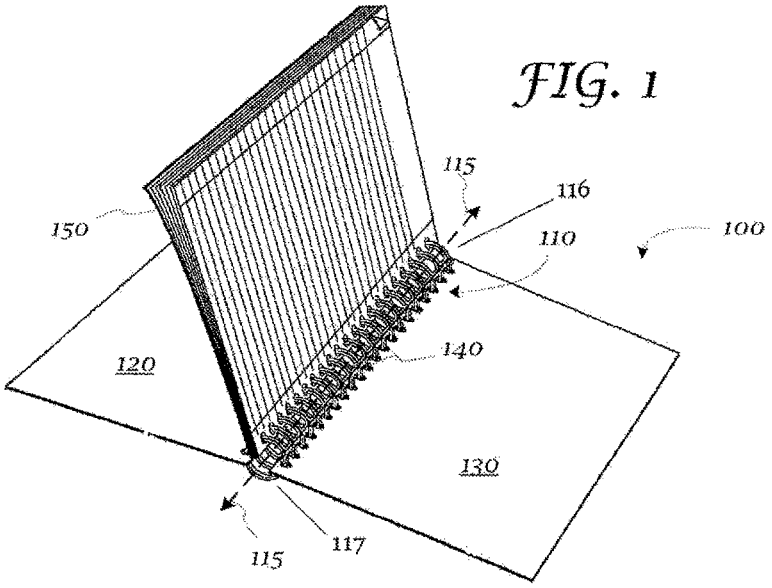
FIG. 1 is a front perspective view of an opened notebook utilizing a twin-wire binding apparatus.

FIG. 1 is a perspective view of a notebook 100 utilizing a twin-wire binding system, device, mechanism or apparatus 110. The twin-wire binding apparatus 110 can be used to bind or couple together any of a wide variety of bound components, including papers 150, a front cover 120, back cover 130, folders, dividers, pocket divider, worksheets, storage pouches, functional devices, workbook pages or other content pages, combinations thereof, or other content. The front cover 120 and back cover 130 may each be thicker and/or more rigid than each sheet of paper 150 to provide protection and stiffness to the notebook 100. Each sheet of paper 150 and each of the front cover 120 and back cover 130 include a row of holes 140 near an outer edge thereof. The holes 140 are sized and spaced to receive a turn or coil of the twin-wire binding apparatus 110 therein to allow the individual pages of the paper 150 and/or covers 120, 130 to be bound and/or turned as in a book. The twin-wire apparatus 110 may include or extend along a central longitudinal or lengthwise axis 115, and may extend from a top end 116 to a bottom end 117.

Figure 2:
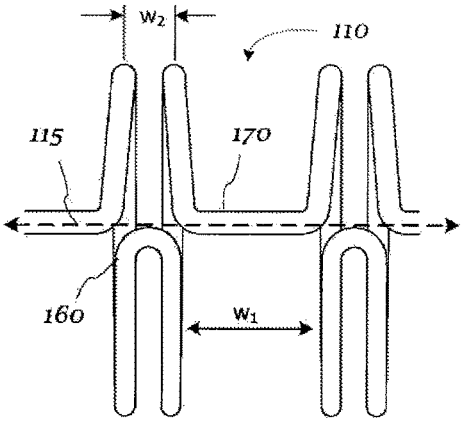
FIG. 2 is an detail top view of the twin-wire binding apparatus of FIG. 1.

FIG. 2 provides a more detailed illustration of a section of the twin-wire apparatus 110. While termed a twin-wire apparatus, the apparatus 110 may be comprised of a continuous single wire that is configured to appear as an apparatus in which each loop is made of two parallel, but spaced apart wires. The so-called "twin-wire" binding may be constructed of a single wire shaped or otherwise formed so that two wires extend through most or all of the binding holes 140. The single continuous wire may be bent in a generally circular manner about the lengthwise axis 115 to form the plurality of loops. The binding apparatus 110 may be constructed from a single unitary piece of material, such as plastic or metal wire (or other materials), and may have a thickness (i.e., diameter) of between about 0.2 mm and about 2 mm.

The twin-wire configuration may be formed by bending the wire into opposing alternating generally u-shaped, tip sections 160 and joining sections 170. Each of the joining sections 170 extends generally parallel to the axis 115 and has a width of $w_1$ while each of the tip sections 160 has a width of $w_2$. Width $w_2$ may be less than that of width $w_1$ and configured such that each tip section 160 can extend through a binding hole 140.

Figure 4:
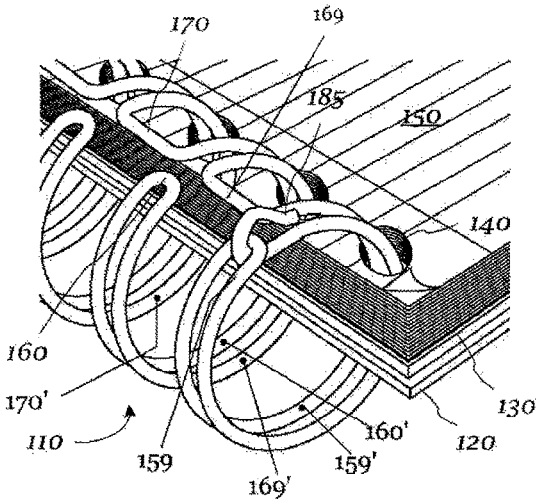
FIG. 4 is an illustration of a coil-lock embodiment for a twin-wire binding system after closure according to an embodiment of the invention.

Each joining section 170 may be substantially c-shaped in side view and curve about 180° about the axis 115 above the axis 115 with reference to the drawing of FIG. 2 (to the right of the axis 115 with reference to FIG. 4). The tip 160 sections may also be substantially c-shaped in side view and curve about 180° about the lengthwise axis 115 below the axis 115 with reference to FIG. 2 (to the left of the axis 115 with reference to FIG. 4). Based on the characterization above, the termination of each tip section 160 may be the beginning of each joining section 170. Similarly, the termination of each joining section 170 may be located approximately at the beginning of each tip section 160.

As shown in FIG. 4, the binding apparatus 110 may have an end coil at the top 116 and/or bottom 117 axial end thereof, the end coil having a tip section 159 and a joining section 169. The wire making up the end-most tip section 159 may be considered to extend to termination point 159', at which same point the wire begins the adjacent joining section 169. Joining section 169 may be considered to extend to termination point 169', at which same point the wire begins the next tip section 160. Tip section 160 may be considered to extend to termination point 160', at which same point the wire begins the adjacent joining section 170. Joining section 170 may be considered to extend to termination point 170', at which same point the wire begins the next tip section, and so on. The termination points described here, which are approximately half-way around the binding apparatus 110, or opposite or about 180 degrees for the "open" gap between the tip sections and joining sections, are only examples and are not meant to be limiting. By bending the wire in the manner described, the overall appearance of the apparatus is that of a twin-wire apparatus 110, but accomplished with a single wire.

The tip 160 and joining 170 sections can also be defined or considered in other manners. For example, in one case each tip section 160 can be considered the sections of the binding apparatus 110 including two parallel wire sections that extend in a generally circular/circumferential manner, nearly 360 degrees about the axis 115. Under this construction each tip section 160 can also be termed a coil, coil section or binding coil, which are coaxially arranged. Each tip section 160 can terminate in a tip where the two parallel wires meet.

Under this construction each coil section 160 can be connected to an adjacent coil section by a joining or connecting section 170 positioned therebetween. In this case each joining section 170 can constitute only the straight, axially-extending portions of the wire apparatus; for example, the section indicated by the dimension $w_1$ in FIG. 2; and all circumferentially extending portions of the twin-wire apparatus 110 are considered a coil section 160.

Since the twin-wire binding systems described herein are of finite length there is necessarily a beginning and an end of the twin-wire apparatus 110, for example at top end 116 and bottom end 117. It is at these ends that the twin-wire apparatus 110 traditionally does not have a defined termination or locking mechanism. In addition, without such a closing or locking mechanism, the bound component, such as the papers 150, covers 120/130 and/or other bound components can be fully or partially separated from the binding apparatus 110 due to the open gap along the entire length of a traditional twin-wire apparatus 110.

Many of the embodiments set forth below describe various embodiments that serve as locking or closure mechanisms for twin-wire binding apparatuses like that shown in FIGS. 1, 2 and 4. Each of the locking mechanisms described below may be capable of ensuring that paper, covers, and/or other contents bound by the binding apparatus cannot fully escape the binding apparatus. While each of the embodiments vary from one another, the reference numbers in the figures remain consistent for consistent elements, such as the twin-wire apparatus 110 as a whole, the tip sections 160, joining sections 170, front cover 120, back cover 130, holes 140 and paper 150.

Figure 3A:
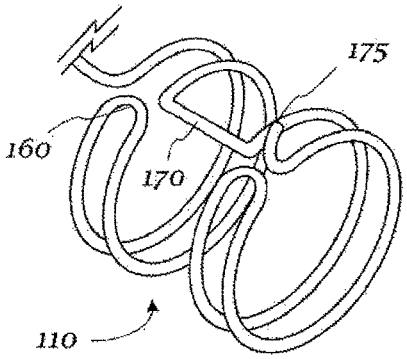
FIG. 3*a* is an illustration of one end of a coil-lock twin-wire binding mechanism prior to closure/locking according to an embodiment of the invention.

A first embodiment, which may be termed a coil-lock, is shown in FIGS. 3*a*-3*d* and FIG. 4, and is an embodiment in which at least one binding coil is circumferentially attached to itself, or to a connection portion. FIG. 3*a* illustrates of one end of a coil-lock twin-wire apparatus prior to closure according to this embodiment in which a section of a twin-wire apparatus 110 has a defined end 175. The twin-wire apparatus 110 has been cut/terminated and is shown with its end 175 bent outwards before it has been locked around the nearest opposing tip section 160. The cut may be made after that last opposing tip section 160 has been formed and before completion of the next joining section 170 to yield sufficient free wire to thread through an opposing tip section 160, bend and clamp back on itself. It is to be understood that the opposing tip section 160 may be the nearest opposing tip section 160 which may reduce the amount of wire material required. However, the end 175 can be bent about other tip sections 160 besides the tip section 160 at the end thereof. Manufacturing preferences will indicated which tip section 160 will receive wire end 175 and the length of wire material required to create this locking section.

Figure 3B:
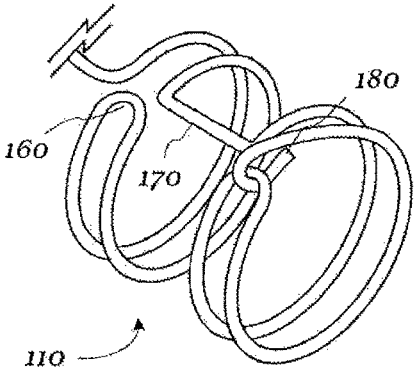
FIG. 3*b* is an illustration of a first closure configuration showing one end of a coil-lock twin-wire apparatus according to an embodiment of the invention.

FIG. 3*b* illustrates a first closure configuration showing one end of a coil-lock twin-wire apparatus. In FIG. 3*b* the end or extension portion 180 is extended over the nearest opposing tip section 160, deflected radially inwardly into a loop and clamped back on or toward itself thereby closing or locking the end 180 with the rest of the twin-wire apparatus 110. The end 180, or other adjacent portions, may make contact with the twin wire apparatus, or may be sufficiently closed to form a gap smaller than the thickness of the wire, or may form a larger gap.

Figure 3C:
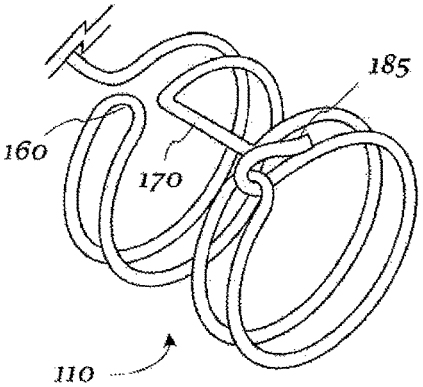
FIG. 3*c* is an illustration of a second closure configuration showing one end of a coil-lock twin-wire apparatus according to an embodiment of the invention.
Figure 3D:
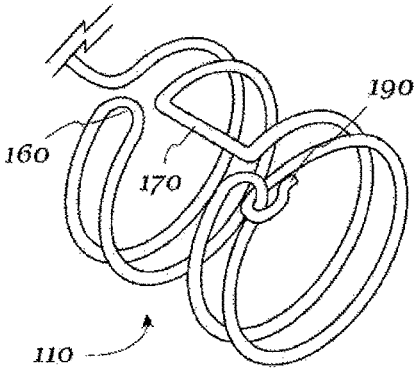
FIG. 3*d* is an illustration of a third closure configuration showing one end of a coil-lock twin-wire apparatus according to an embodiment of the invention.

FIG. 3*c* illustrates a second closure configuration in which the end 185 is threaded through the nearest opposing tip section 160, bent radially outward and bent back on or toward itself thereby closing or locking the end 185 with the rest of the twin-wire apparatus 110. FIG. 3*a* may illustrate the embodiment of FIG. 3*c* prior to threading and bending the end 175/185. FIG. 4 illustrates essentially the same configuration as FIG. 3*c* but shows the twin-wire apparatus 110 in conjunction with the front cover 120, rear cover 130 and sheets of paper 150. FIG. 3*d* illustrates a third closure configuration in which the end 190 is threaded through the nearest opposing tip section 160, bent sideways and clamped back on or toward itself thereby closing or locking the end 190 with the rest of the twin-wire apparatus 110. In this configuration and all of the other locking configurations described above, the last, or axial-end, holes 140 receive a turn of the wire apparatus in a two-wire configuration.

Figure 5A:
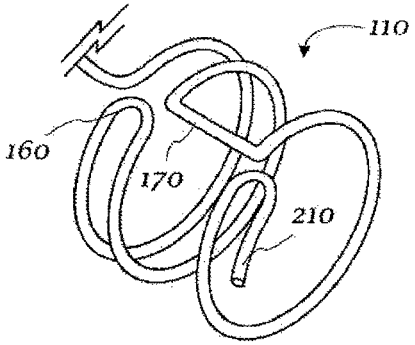
FIG. 5*a* is an illustration of one end of a coil-lock twin-wire apparatus prior to closure/locking according to an embodiment of the invention.

FIGS. 5*a*-5*c* and FIG. 6 illustrate a second embodiment of the coil-lock. FIG. 5*a* illustrates of one end of a coil-lock twin-wire apparatus 110 prior to closure according to this particular embodiment. A section of a twin-wire apparatus 110 is shown with its end 210 bent generally radially inwardly before it has been looped/locked around the nearest opposing joining section 170. The wire of the binding apparatus 110 may be cut at end 210 after that last opposing tip section 160 has been fully formed to yield enough free wire to be threaded through an adjacent opposing joining section, for example the nearest opposing joining section 170, then bent and clamped back on itself. As explained in the prior embodiment the length of free wire adjacent to the end 210 may be adjusted based on manufacturing preferences, as may the location of the opposing joining section that the free wire is bent around to create the locking section. The opposed joining section may be the immediately adjacent joining section, or the next joining section after the immediately adjacent joining section, or a more distant joining section.

Figure 5B:
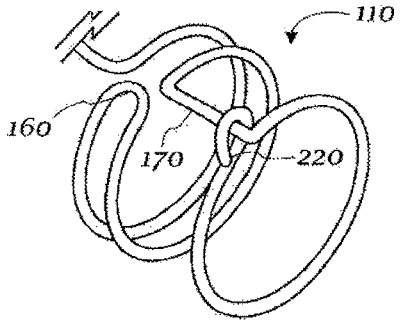
FIG. 5*b* is an illustration of a first closure configuration showing one end of a coil-lock twin-wire apparatus according to an embodiment of the invention.
Figure 5C:
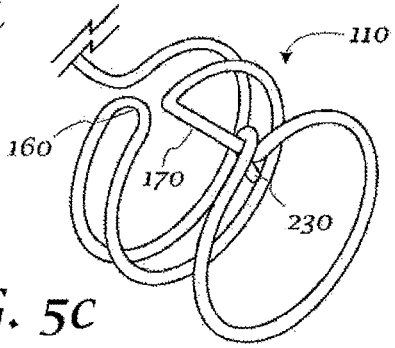
FIG. 5*c* is an illustration of a second closure configuration showing one end of a coil-lock twin-wire apparatus according to an embodiment of the invention.
Figure 6:
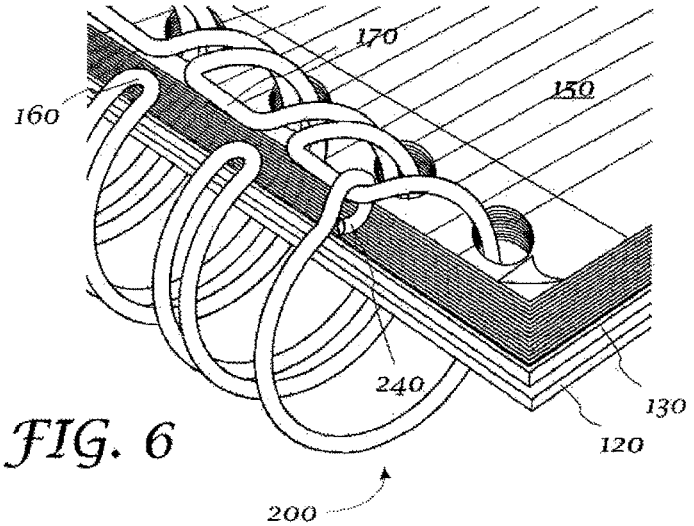
FIG. 6 is an illustration of a coil-lock embodiment for a twin-wire binding system after closure according to an embodiment of the invention.

FIG. 5*b* illustrates the end 220 passed under the nearest opposing joining section 170, bent radially outwardly and clamped back on or toward itself thereby closing or locking the end 220 with the rest of the twin-wire apparatus 110. FIG. 5*c* illustrates the end 230 passed over the nearest opposing joining section 170, bent radially inwardly (or sideways) and clamped back on or toward itself thereby closing or locking the end 230 with the rest of the twin-wire apparatus 110. FIG. 6 illustrates essentially the same configuration as FIG. 5*c* but shows the twin-wire apparatus 110 in conjunction with the front cover 120, rear cover 130 and sheets of paper 150. In this configuration and all of the other above locking configurations of FIGS. 5*a*-5*c* and FIG. 6, the last, or axial-end, holes 140 receive a turn of the wire apparatus in a single-wire configuration.

Figure 7:
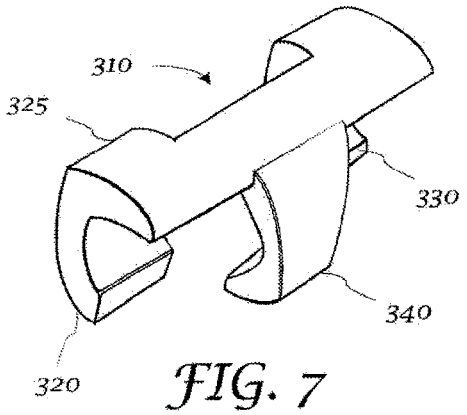
FIG. 7 is a perspective view of a coil spine joint.

FIGS. 7-10 illustrate another embodiment, termed a spine joint herein, in which a locking device is utilized to generally circumferentially and/or axially couple portions of the binding apparatus. FIG. 7 is a perspective view of one embodiment of the locking device/coil spine joint. The coil spine joint 310 generally may include spine section 325 and a pair of joining hook sections 320, 330 coupled to the spine section 325 at either axial end thereof and on the same side thereof. The coil spine joint 310 may also include a tip hook section 340 coupled to the spine section 325 at an opposite side compared to the joining hook sections 320, 330. Tip hook section 340 opposes and is disposed between joining hook sections 320 and 330. The coil spine joint 310 is constructed and adapted to engage adjacent joining sections 170 and an opposing tip section 160 of the binding apparatus 110. The coil spine joint 310 may be made or formed from a variety of materials, including injection molded plastic/polymers, blow molded plastic/polymers, or any other formed plastic or polymer. Alternately, the coil spine joint 310 may be made or formed from stamped or die cut sheet metal or sheet plastic/polymer, cast or diecast metal or plastics/polymers, resins, resin based materials or composites, or the like. Those of ordinary skill in the art can readily conceive of other materials from which the coil spine joint 310 may be fashioned, or other methods of forming the materials, without departing from the spirit or scope of the disclosure herein.

Figure 8:
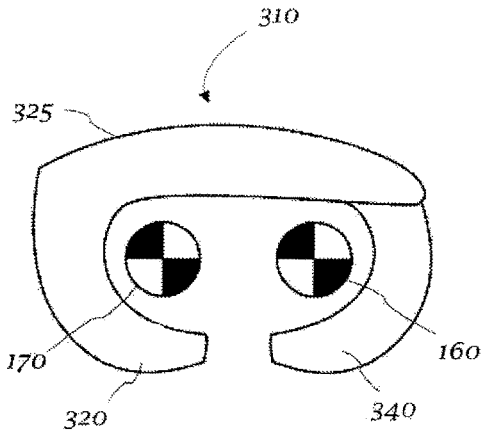
FIG. 8 is an end view of the coil spine joint of FIG. 7.

FIG. 8 is an end view of the coil spine joint 310 of FIG. 7. In this view, joining hook section 320 is shown cooperatively engaging (e.g., wrapped around) a cross-sectional view of joining section wire 170. Similarly, tip hook section 340 is shown cooperatively engaging (e.g., wrapped around) a cross-sectional view of tip section wire 160. Each hook section 320, 330, 340, possibly in combination with the spine section 325, may extend at least about 180 degrees around the associated section 160, 170.

Figure 9A:
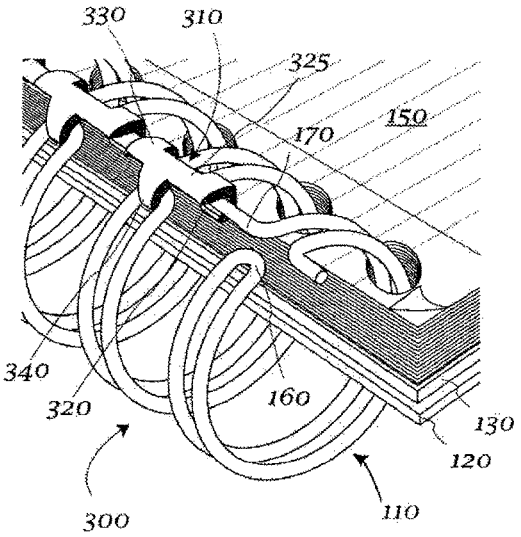
FIGS. 9A and 9B are illustrations of various coil spine joint locking devices for a twin-wire binding system attached to the twin-wire apparatus and further showing paper and cover material bound together according to an embodiment of the invention.

FIG. 9A is an illustration of the locking device 300 of FIGS. 7 and 8 attached to the twin-wire apparatus 110 in conjunction with paper 150 and covers 120, 130. At least one coil spine joint 310 is cooperatively fitted about twin-wire apparatus 110 such that joining hook sections 320, 330 are mechanically hooked onto adjacent joining sections 170 of twin-wire apparatus 110 while tip hook section 340 is mechanically hooked onto an opposing tip section 160 of twin-wire apparatus 110. If desired, however, this configuration can be reversed such that hook sections 320, 330 are joined to tip sections 160, and hook section 340 is joined to a joining section 170, although the spacing and configuration of the coil spine joint 310 may need to be adjusted accordingly. Additional coil spine joints 310 can be similarly hooked onto twin-wire apparatus 110 in the same manner such that there are a series of coil spine joints 310 operatively closing, spanning and/or locking the twin-wire apparatus 110 to keep paper 150 and/or covers 120, 130 or other contents from coming loose from twin-wire binding apparatus 110.

Figure 9B:
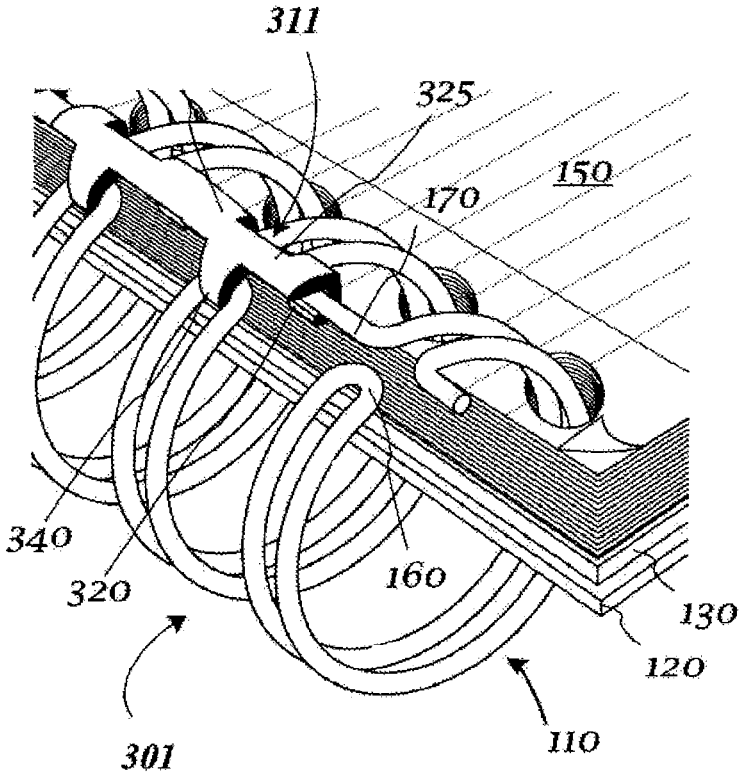

FIG. 9B illustrates a coil spine joint locking embodiment 301 similar to that of FIG. 9A, except that coil spine joint 311 extends axially along multiple sets of joining 170 and tip 160 sections and has extra hook sections. The coil spine joint 311 may extend over two or more sets of joining 170 and tip 160 sections, hooking each set together, or hooking only some of the sets together. At least one coil spine joint 311 is cooperatively fitted about twin-wire apparatus 110 such that joining hook sections 320, 330 are mechanically hooked onto adjacent joining sections 170 of twin-wire apparatus 110 while tip hook section 340 is mechanically hooked onto an opposing tip section 160 of twin-wire apparatus 110. Additional coil spine joints 311 can be similarly hooked onto twin-wire apparatus 11 in the same manner until there are a series of coil spine joints operative to close and lock the twin-wire apparatus 11 to keep paper 150 and/or covers 120, 130 or other contents from coming separating from twin-wire binding apparatus 301.

Figure 10:
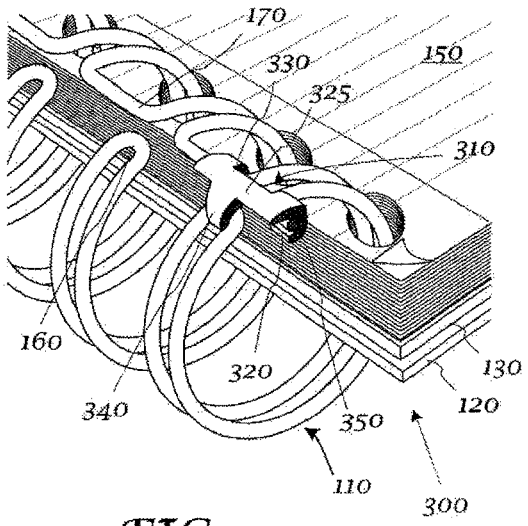
FIG. 10 is an illustration of a coil spine joint locking device for a twin-wire binding system showing the coil spine joint attached to the twin-wire apparatus and covering the end of the twin-wire apparatus according to an embodiment of the invention.

FIG. 10 illustrates a coil spine joint locking embodiment 300 coupled to, positioned adjacent to or covering the end section 350 of the binding apparatus 110. The structure and functionality of the spine joint of FIG. 10 is similar to that of FIGS. 9A and 9B, except that the spine joint of FIG. 10 covers the end section 350 of the twin-wire apparatus 110. The end section 350 is not a complete joining section but rather a joining section that has been cut since the twin-wire apparatus 110 must be cut at some point in order to terminate. FIGS. 9A and 9B show coil spine joints at several locations other than the end of the coil 110, and FIG. 10 shows a coil spine joint on the end of the coil 110. These are only examples and other combinations of locations may be used for the coil spine joints.

One or more coil spine joints 310 may be arranged in a pattern along the length of the twin-wire apparatus 110 to create the closed loop or locked configuration, and coil spine joints 310 may or may not be used on the end sections of the twin-wire apparatus 110. For example, two or more coil spine joints 310 may be hooked onto twin-wire apparatus 110, at least one coil spine joint 310 may be positioned near or adjacent to one end 116 of the twin-wire apparatus 110 and at least one coil spine joint 310 may be positioned near or adjacent to the other end 117 of the twin-wire apparatus 110.

Figure 11:
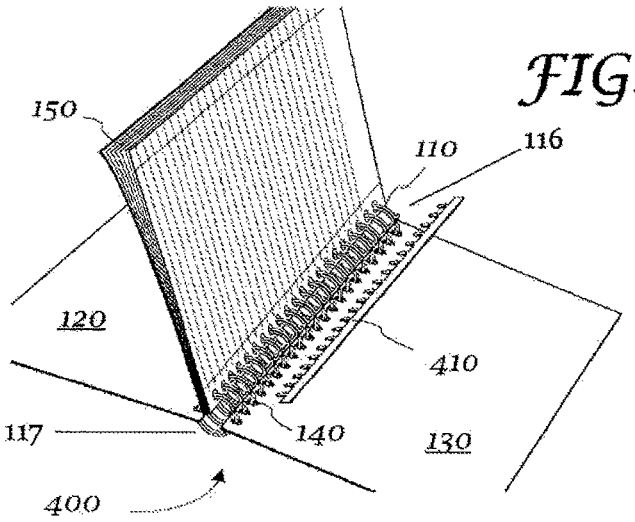
FIG. 11 is a perspective view of a snap-in comb lock device for a twin-wire binding system according to an embodiment of the invention, shown in conjunction with a notebook.
Figure 12:
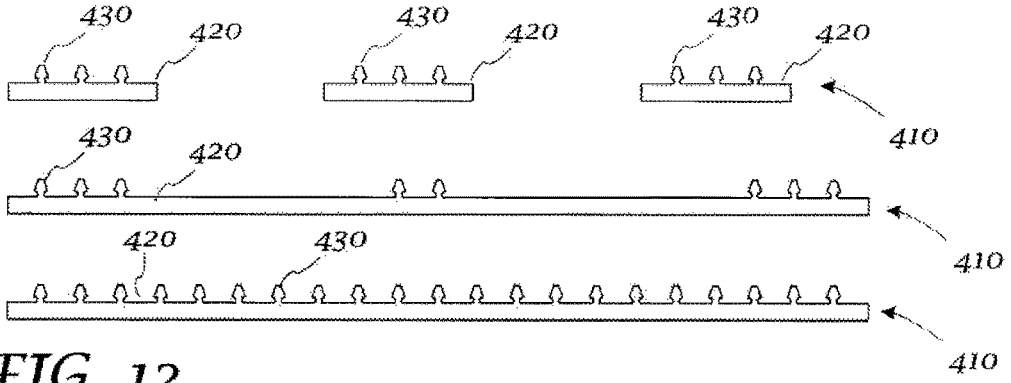
FIG. 12 illustrates top views of multiple snap-in comb lock configurations.
Figure 13:
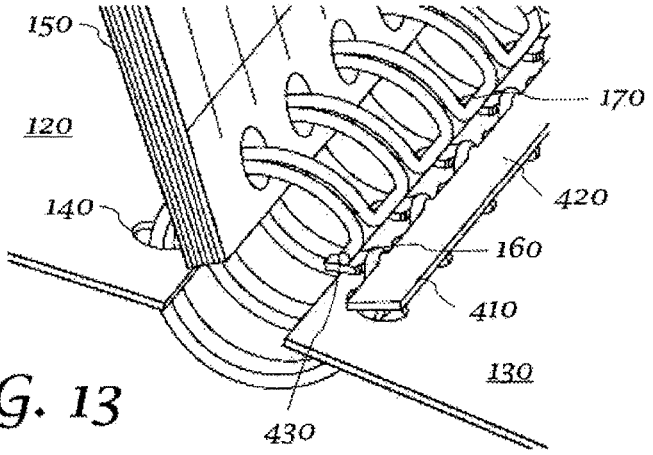
FIG. 13 is an illustration of a snap-in comb lock secured to a binding mechanism, and showing paper and cover material bound together according to an embodiment of the invention.

FIGS. 11-13 illustrate another locking device, termed a snap-in comb coil-lock herein, which axially couples portions of the binding apparatus. FIG. 11 is a perspective view of a snap-in comb lock embodiment 400 shown with a traditional twin-wire apparatus 110 binding a front cover 120, back cover 130 and papers 150. FIG. 11 also shows an exploded snap-in comb lock component 410 positioned for insertion into the twin-wire apparatus 110.

FIG. 12 illustrates top views of various embodiment of the snap-in comb lock component 410. Snap-in comb lock component 410 may generally include a spine element 420 having one, two, or more finger elements 430 spaced along a length thereof. The spine element 420 may be generally flat and planar, and each finger element 430 may be generally flat and co-planar with the spine element 420. Each finger element 430 may include or comprise a catch mechanism protruding substantially 90°, or some other angle, from the spine element 420, and configured such that consecutive finger elements 430 are spaced apart about the same distance as the distance between associated tip sections 160. In this configuration each finger element 430 is adapted to fit into and cooperatively engage a tip section 160. The catch mechanism for the plurality of finger elements 430 shown in FIGS. 11-13 may be generally arrow shaped having a pair of angled leading edges adapted to fit within and spread apart the adjacent wire of a tip section 160.

Each finger element 430 may also include a pair of trailing/retention surfaces configured to engage each wire of the tip section 160 such that after the finger element 430 is fully inserted through a tip section 160 the trailing surfaces act as a catch mechanism to keep the finger element 430 from being pulled out of the binding apparatus 110. Alternately, each finger element 430 may be shaped to be inserted at an angle, or inserted in a two (or more) step operation such that each finger element 430 is inserted, and then the entire comb 410 is moved, for example in the axial direction, to lock the comb 410 in place.

The length of the spine element 420 can be varied from that shown in FIG. 12 such that the spine element 420/component 410 has a length that is generally equal to, or less than, the binding apparatus 110. Also, certain finger elements 430 may be omitted such the component 410 does not engage each of the tip sections 160, but in this case the finger pieces 430 that are present should be spaced to engage some of corresponding tip sections 160. For example the component 410 may engage one, two, or more of the tip sections 160.

FIG. 13 illustrates the snap-in comb lock 410 in conjunction with papers 150 and covers 120, 130 bound together by the binding apparatus 110. In this illustration, the snap-in comb lock component 410 is shown engaged with the twin-wire apparatus 110 via tip sections 160. The tips of the finger elements 430 may be aligned with the loops of tip sections 160. The user or inserting device may then apply a radially inward force to push the finger elements 430 through the loops of the tip sections 160. Each tip 430 may have a width greater than the width between a pair of wires of the tip section 160 such that the twin wires of the tip sections 160 may be spread apart by the leading surfaces as each finger element 430 is inserted therethrough. The twin wires may then converge/snap back together after the associated finger element 430 is fully inserted.

Based on the angled/arrow shape of the finger elements 430, the entire snap-in comb component 410 may remain lockably engaged with the twin-wire apparatus 110, thereby preventing paper 150 and/or covers 120, 130 or other contents from escaping the twin-wire apparatus 110. The finger elements 430 may be shaped such that each finger element 430 can configured such that a lower force is required to insert the finger elements 430 than is required to remove the finger elements.

It should be noted that the specific illustrated locations of the finger elements 430 in conjunction with the binding apparatus 110 is provided as an example. The finger elements 420 may be positioned elsewhere around the circumference of the binding apparatus 110 desired. It may be easier to insert the finger elements 430 at a point approximately 180 degrees around the circumference of the binding apparatus 110 from the point shown in FIG. 13.

This embodiment shows the finger elements 430 as having an arrow shape in general. However, the arrow shape is but one shape which can be utilized and provides a balance between ease of assembly and efficacy of engagement. Other finger element 430 shapes may be adapted for use as a catch mechanism with this embodiment without departing from the spirit or scope of the disclosure herein.

FIGS. 14 and 15 illustrate another binding apparatus system, termed an alternating coil-lock herein. FIG. 14 is a perspective view of a segmented opposite closure embodiment 500. This embodiment utilizes segments 510 of the traditional twin-wire apparatus in which each segment 510 may be shorter than the length of the bound components 120, 130, 150 along axis 115. Moreover, each segment 510 may be circumferentially misaligned and/or reverse oriented from its adjacent segment 510 so that the tip sections 160 of one segment 510 point in a direction that is substantially 180° reversed from the tip sections 160 in an adjacent segment 510 (or the tips 160 are positioned on opposite sides of the axial gap; or the axially-extending gaps of segments 510 are misaligned, or misaligned by 180°).

Thus, one or more segments 510*a* each may have their tip sections 160 pointing in one direction (or the tips 160 are positioned on the right side of the axial gap, or their gaps are at a top end thereof) while the adjacent reversed one or more segments 510*b* have their tip sections 160 pointing in a direction that is 180° in the opposite direction (or the tips are positioned on a left side of the axial gap, or their gaps are at a bottom end thereof). By reversing the orientation of successive/adjacent segments 510*a*, 510*b*, any gaps that may exist in a traditional twin-wire apparatus are offset in each adjacent segment lessening the chance that the pages 150 and/or covers 120, 130 or other contents can come loose from the binding system.

FIG. 15 is a perspective view of three successive segmented opposite closure twin-wire segments 510*a*, 510*b*. The two end segments 510*a* are shown with a larger gap between tip sections 160 and joining sections 170 than will be present when the end segment 510*a* are closed about covers 120, 130 and paper 150, but are shown in this configuration for illustrative purpose to show the loading position prior to closing. The middle segment 510*b* is shown with the gap between tip sections 160 and joining sections 170 much closer together, which is generally the appearance after the covers 120, 130 and paper 150 and/or other contents have been installed and the coil segment 510*b* closed.

The desired results for this embodiment can be achieved with a minimum of two reverse oriented segments. FIG. 14 illustrates five segments. One of ordinary skill in the art will readily understand that any number of alternating reverse oriented segments 510*a*, 510*b* can be implemented for this embodiment.

FIGS. 16 and 17 illustrate another embodiment of the locking device which generally circumferentially joins portions of the binding apparatus, termed a solder coil-lock herein. FIG. 16 illustrates a solder lock embodiment 600 for a twin-wire binding system according to an embodiment of the invention. In this embodiment 600, the traditional twin-wire apparatus 110 is shown with tip sections 160 opposing joining sections 170 and binding together one or more cover(s) 120/130 and paper 150 via holes 140. This embodiment utilizes a solder weld 610 that joins and closes/circumferentially extends across the gap between the tip sections 160 and opposing joining sections 170. The solder weld 610 partially surrounds and adheres to the wires comprising the tip section 160 and opposing adjacent joining sections 170. In this embodiment the solder weld 610 may extend about 180° about each tip section 160, along the outer edge of the tip section 610. The solder weld 610 may have a total length, extending along the axis 115, of less than or about equal to about twice the maximum width of each tip section 160 to provide a materials saving while still providing a sufficient bond/coupling FIG. 17 is an illustration of an alternate solder lock in which the solder weld covers more area around and about the tip sections 160 and joining sections 170 as compared to the embodiment of FIG. 16. In the embodiment of FIG. 17 the solder weld 610 completely surrounds and adhere to the wires comprising the tip section 160 and opposing adjacent joining sections 170, filling in the center portion of the distal end of the tip section 160.

The coupling/closure devices of FIGS. 16 and 17 have been described thus far as using "solder welds" which can imply formation using a hot molten metal that wets and sticks to the wire surfaces of the tip sections 160 and joining sections 170 and then cools into a solid. In this case the solder welds 610 may be achieved by wave soldering, manual soldering, or other soldering methods. However, it should be noted that other materials could be used in including, but not limited to, adhesives and or molten/meltable/thermoplastic plastic or polymer substances that can be melted and cooled to form the solder welds 610. Thus, the solder weld 610 may include or be made of, among other materials, a metal solder, a plastic or polymer solder or an adhesive material, or combinations thereof.

One or more solder welds 610 may be applied at various positions to the twin-wire binding mechanism 110. In one case one solder weld 610 may be located proximate to one end 116/117 of the twin-wire binding mechanism 110 and another solder weld 610 may be placed proximate to the opposite end 116/117 of the twin-wire binding mechanism 110. This particular placement may be advantageous for maintaining the covers 120/130, paper 150, and/or other contents within the twin-wire binding mechanism 110 with relatively little material and manufacturing costs. However, manufacturing preferences will dictate how many solder welds 610 are used along the twin-wire binding mechanism 110, and their location.

Figure 18:
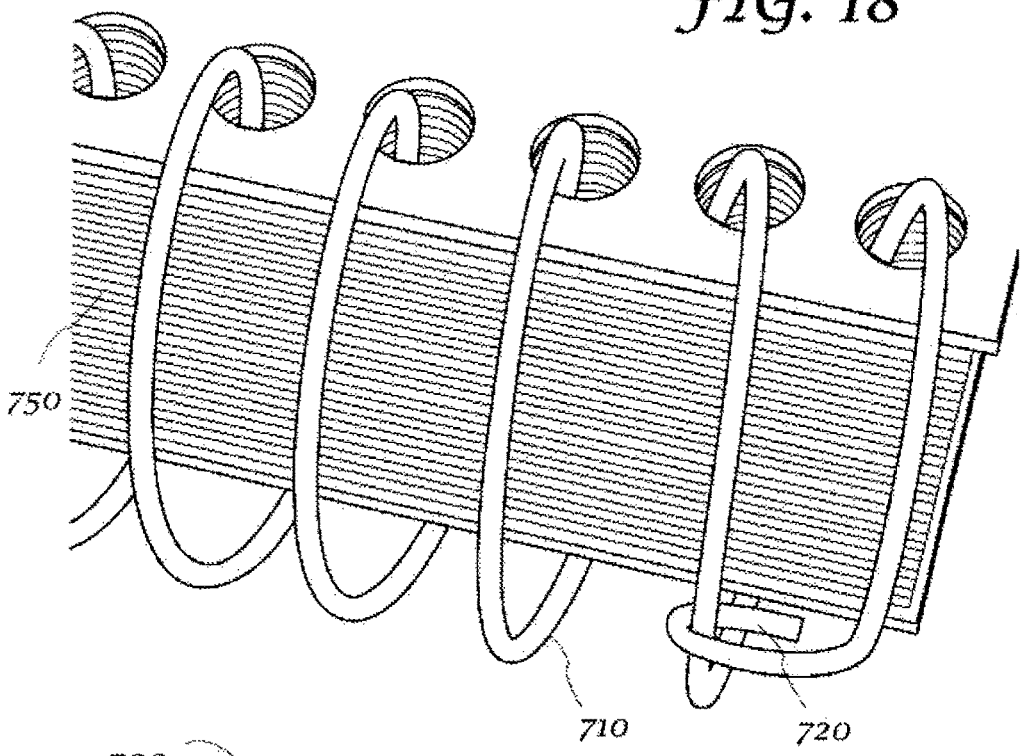
FIG. 18 is a detail illustration of an end of a spiral wire binding system.
Figure 19:
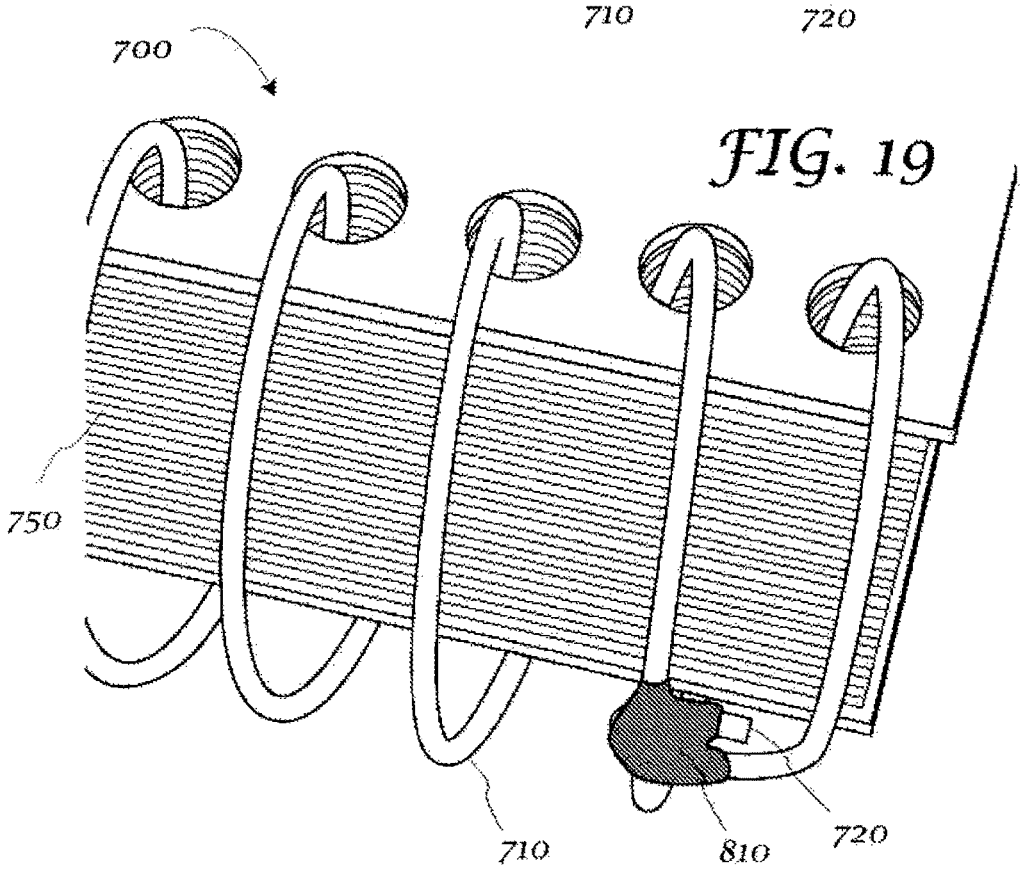
FIG. 19 is an illustration of a solder lock covering a section of the spiral wire apparatus of FIG. 18.

FIGS. 18 and 19 illustrate a binding apparatus, termed a solder spiral-lock herein. It should be noted that FIGS. 18 and 19 illustrate a spiral wire binding system including a wire 710 that is formed into helix of successive coils that are threaded through the holes 140 in paper 150, in contrast to the twin-wire binding mechanism 110 as shown in, for example, FIGS. 1 and 2. The spiral wire 710 terminates in a loop 720 that encases or is wrapped around the last coil of wire 710. FIG. 18 illustrates a spiral wire binding system with the ends of the spiral wire binding system not being permanently secured.

FIG. 19 is an illustration of a solder lock embodiment 700 covering a section of a spiral wire apparatus. FIG. 19 is identical to FIG. 18 with the addition of a solder weld 810 about loop 720. The solder weld 810 locks, covers, and secures loop 720 to coil wire 710 preventing the loop 720 from coming loose from coil wire 710. The solder weld 810 may be proximate to one end (top end 116 or bottom end 117; see for example FIG. 1) of the spiral wire apparatus. A second solder weld 810 may be proximate to the opposite end (bottom end 117 or top end 116) of the spiral wire apparatus. FIG. 19 has been described as using "solder welds," but the solder welds 810 can be made of the various materials and processes outlined above with respect to the solder welds 610.

Figure 20:
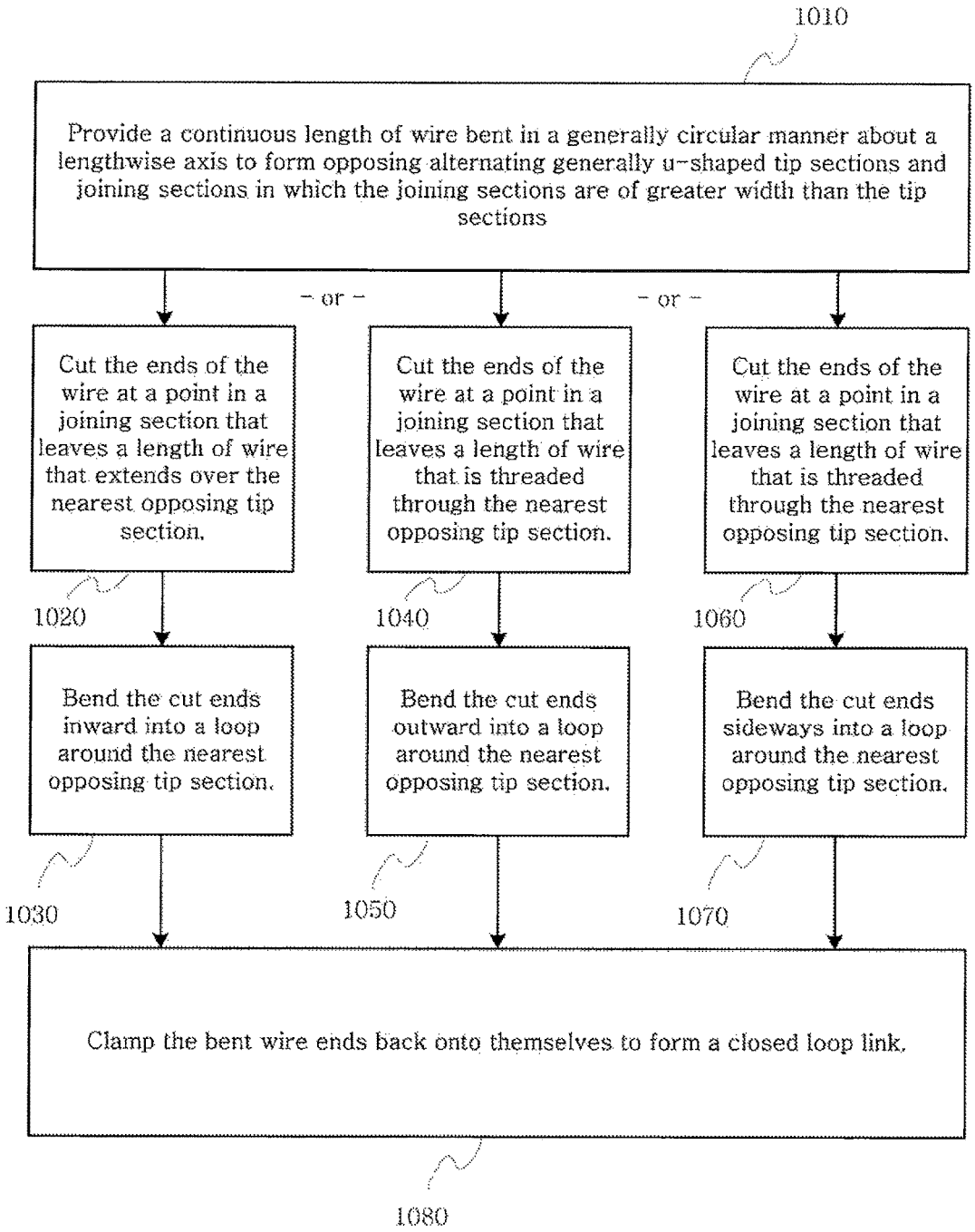
FIG. 20 is a flowchart illustrating various methods which may be utilizing for locking a twin-wire binding apparatus.

FIG. 20 is a flowchart illustrating a first method of coil locking a twin-wire binding apparatus, some of which may be shown in FIGS. 3*a*, 3*b*, 3*c*, 3*d*, 4, 5*a*, 5*b*, 5*c* and 6. At block 1010, a continuous length of wire may be bent in a generally circular manner about a lengthwise axis to form opposing alternating generally u-shaped tip sections and joining sections in which the joining sections may be of greater width than the tip sections. In a first method embodiment, at block 1020, the ends of the wire may be cut at a point in a joining section that leaves a length of wire that extends over the nearest opposing tip section. At block 1030, the cut ends may be bent inward into a loop around the nearest opposing tip section, as shown in FIG. 3*b*.

In a second method embodiment, at block 1040, the ends of the wire may be cut at a point in a joining section that leaves a length of wire that is threaded through the nearest opposing tip section. At block 1050, the cut ends may be bent outward into a loop around the nearest opposing tip section, as shown in FIG. 3*c*. In a third method embodiment, at block 1060, the ends of the wire may be cut at a point in a joining section that leaves a length of wire that is threaded through the nearest opposing tip section. At block 1070, the cut ends may be bent sideways into a loop around the nearest opposing tip section, as shown in FIG. 3*d*. For each of the above method embodiments, at block 1080, the bent wire ends may be clamped back onto themselves to form a closed loop link.

Figure 21:
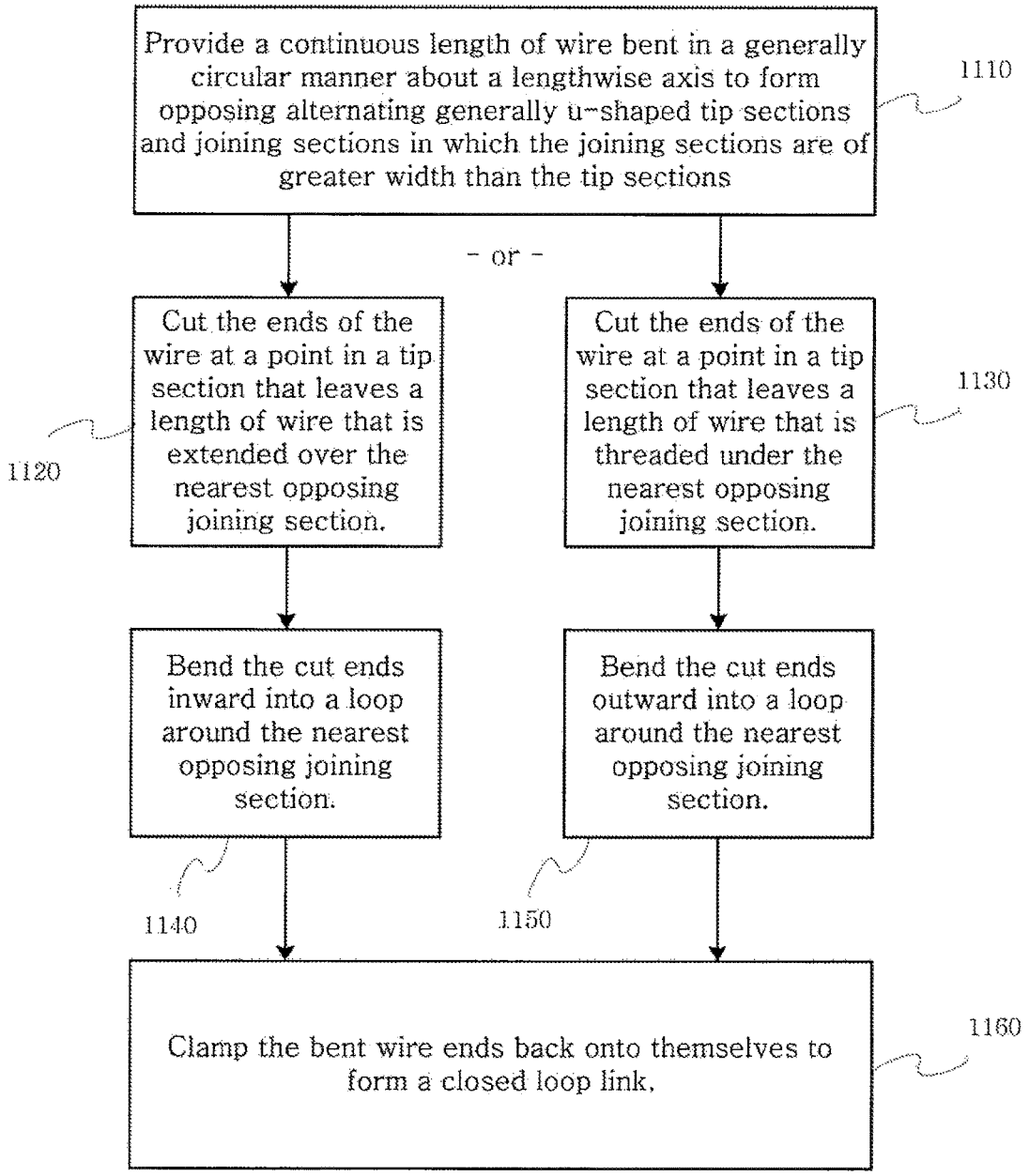
FIG. 21 is a flowchart illustrating additional methods which may be utilized for locking a twin-wire binding apparatus.
Figure 22A:
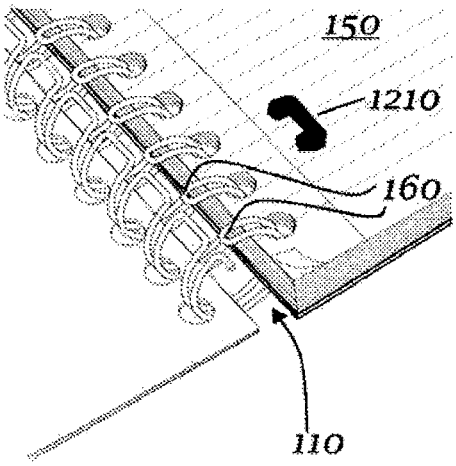
FIGS. 22*a-d* are illustrations of "staple" type devices for locking together (along the binding axis) consecutive loops of a twin-wire binding apparatus.
Figure 22B:
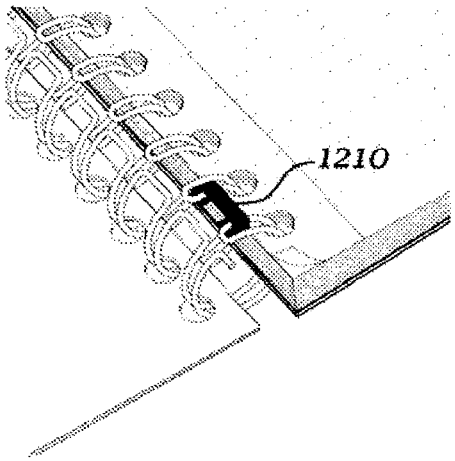
Figure 22C:
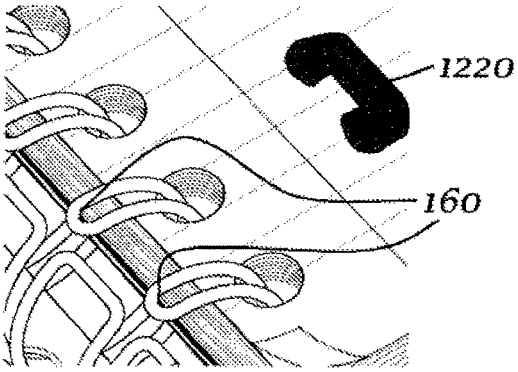
Figure 22D:
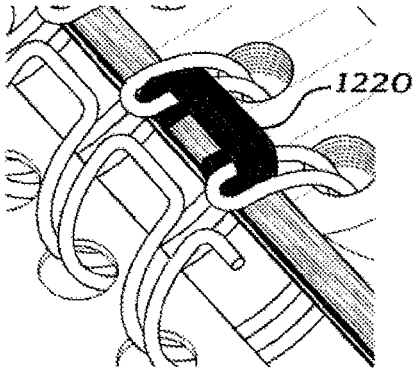

FIG. 21 is a flowchart illustrating another method of locking a twin-wire binding apparatus. At block 1110, a continuous length of wire may be bent in a generally circular manner about a lengthwise axis to form opposing alternating generally u-shaped tip sections and joining sections in which the joining sections may be of greater width than the tip sections is provided. In a fourth method embodiment, at block 1120, the ends of the wire may be cut at a point in a tip section that leaves a length of wire that is extended over the nearest opposing joining section. At block 1140, the cut ends may be bent inward into a loop around the nearest opposing joining section. At block 1160, the bent wire ends may be clamped back onto themselves to form a closed loop link, as shown in FIG. 5*c*.

In a fifth method embodiment, at block 1130, the ends of the wire may be cut at a point in a tip section that leaves a length of wire that extends to or is threaded through an opposing joining section. At block 1130, the cut ends may be threaded under (or bent into proximity with) the opposing joining section. At block 1150, the cut ends may be bent outward into a loop around the opposing joining section. At block 1160, the bent wire ends may be clamped back onto themselves to form a closed loop link, as shown in FIG. 5*b*.

FIGS. 22*a*-22*d* show various locking devices and methods for locking adjacent tip sections 160 of a twin-wire binding apparatus 110, using devices termed staples herein. The term "staples" is used for ease of explanation herein, but is not meant to be limiting to any particular size, shape or configuration, except where indicated otherwise. For example, the staples may be formed of a wire or wire-like material that may be formed or bent to shape, but can be made of a variety of materials and formed in a variety of shapes and have varying thickness. Metal staples 1210 (FIGS. 22*a* and 22*b*) or plastic/polymer staples 1220 (FIGS. 22*c* and 22*d*) may be used, or the staples can be made of any of a variety of materials, including the materials listed above for the spine joint 310.

As shown in the Figures, the staples may span adjacent tip sections 160, with the ends of each staple passing through the loop of the tip section 160, and being turned inward (or outward) as shown to be secured to the loop of the tip sections 160. The staples 1210, 1220 may be wider or narrow (in the circumferential direction) than shown. Wider staples 1210, 1220 may reduce the capacity of the binding apparatus 110 or limit the rotation of its contents, but may provide a stronger and/or more secure connection.

The staples 1210, 1220 may have a generally straight back or spine that is oriented along the axis 115 of the binding mechanism. Each staple 1210 may have curved tips or hook portions at either end that are curved or turned back on themselves about 180 degrees in one case (as is conventionally done with metal staples that hold together multiple sheets of paper) such that the tips are generally parallel to the spine. Alternately, if desired the ends of the staples 1210, 1220 may be turned outward as is sometimes done with metal staples that hold together multiple sheets of paper.

The staples 1210, 1220 may be preformed and snapped over the wires 160, or they may be partially formed (i.e. the tips can be partially bent, such as 90 degrees instead of the full 180 degrees) and then the tips can be turned fully inward (or outward) after passing through loops 160. The staples 1210, 1220 may be installed on one or both ends of the binding apparatus 110 or they may be installed elsewhere along the binding apparatus 110 including across every pair of loops 160. Each staple 1210 can have an increased length relative to the binding mechanism 110 shown in the figures herein such that each staple 1210 spans, for example, more than two loops 160.

Figure 23A:
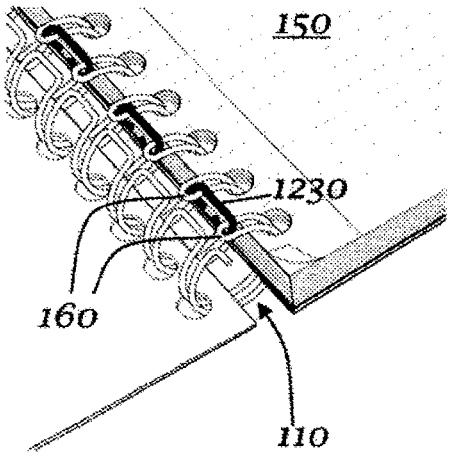
FIGS. 23*a-c* are illustrations of other "staple" type devices for locking together (along the binding axis) consecutive loops of a twin-wire binding apparatus.
Figure 23B:
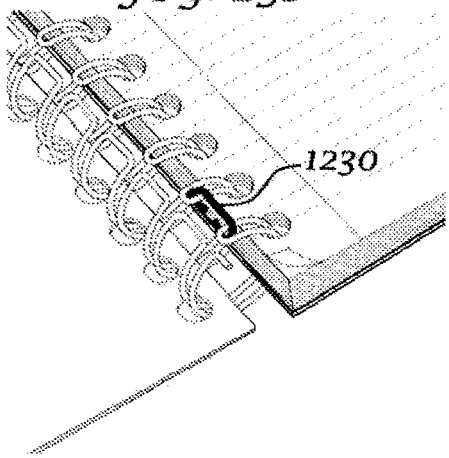
Figure 23C:
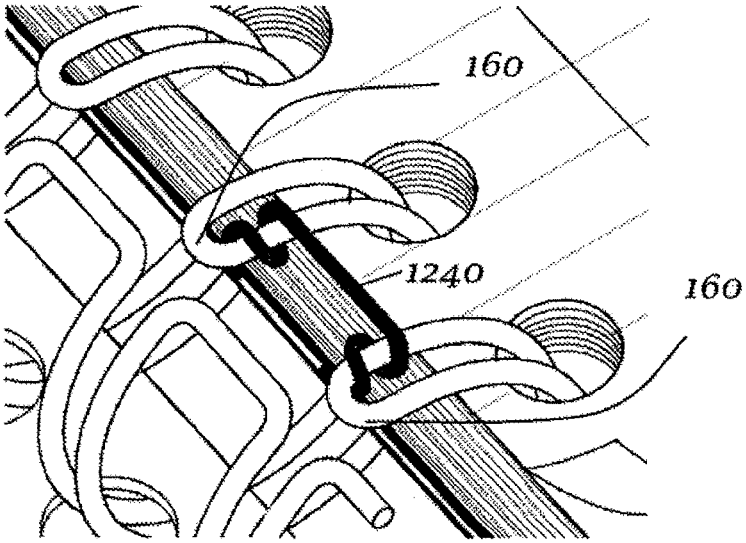

The staples 1210, 1220 may have a rectangular cross section (as shown in FIGS. 22*a*-*d*) or may have a circular cross section or cross sections of other shapes. FIGS. 23*a*-*c* show other forms of staples 1230, 1240 that have a circular cross section, for example a metal or plastic wire. In FIG. 23*a*, staples 1230 are used to join each pair of tip sections 160, each staple 1230 being wrapped about 180 degrees around the wire of each tip section. In FIG. 23*b*, only the end pair of tip sections 160 are joined by a staple 1230. FIG. 23*c* shows a detail of staple 1240 whose ends are wrapped more than a full turn around wire of the tip sections 160, for example between 360 and 540 degrees or greater, or at least about 360 degrees. The wires/free end of the staples 1230, 1340 may be wrapped "toward" the adjacent associated tip section 160 as shown in FIG. 23*c*, but could also instead be wrapped in the opposite "away" direction.

Figure 24A:
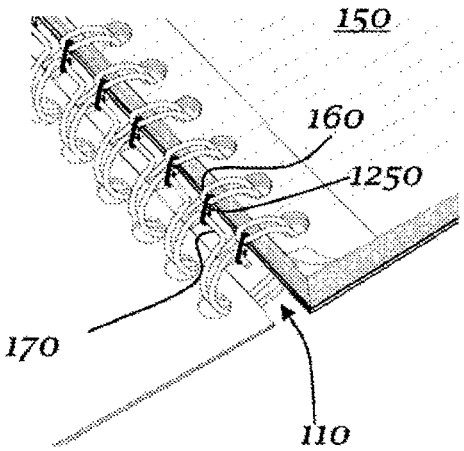
FIGS. 24*a-d* are illustrations of "staple" type devices for locking together (across the axial gap) adjacent loops of a twin-wire binding apparatus.
Figure 24B:
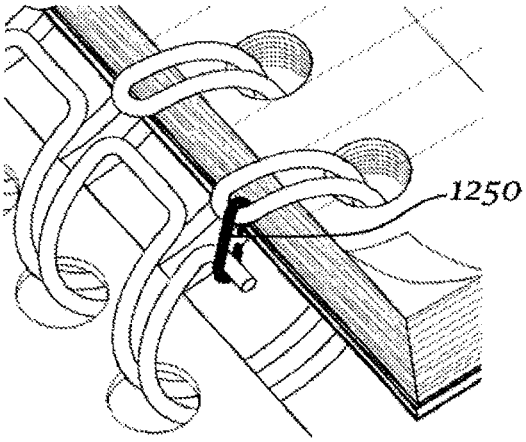

FIGS. 24*a*-24*d* show various structures and methods for locking tip sections 160 to associated, opposite joining sections 170 of a twin-wire binding apparatus 110, using staples. Again the term "staples" is used for convenience and is not meant to be limiting, and can include the various materials, structures and arrangements described above. As shown in FIG. 24*a*, in one embodiment a staple 1250 may extend from each tip section 160 across the axially-extending gap of the binding mechanism 110 to one of the adjacent, opposite joining sections 170. As shown in FIG. 24*b*, a staple 1250 may be used only at one or both axial ends of the twin-wire binding mechanism 110, binding the end tip section 160 to either the last (partial) joining section 170 (as shown) or last full joining section (not shown in FIG. 24*b*). Staples 1250 may be used at every tip section 160, or at one or both ends 116, 117, or be placed anywhere along the binding mechanism 110 according to manufacturing preference. Each staple 1250 can be considered to have a spine extending at an angle to the axis 115, with a pair of hook portions at either end thereof.

Figure 24C:
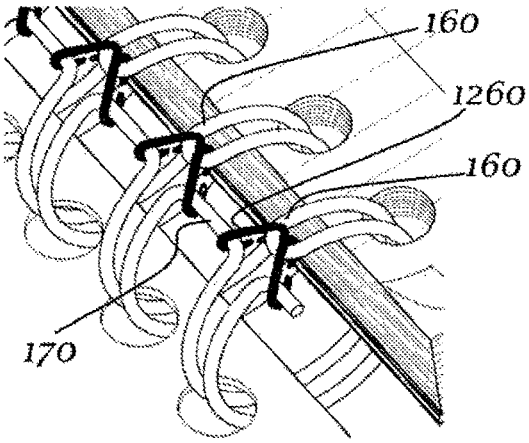
Figure 24D:
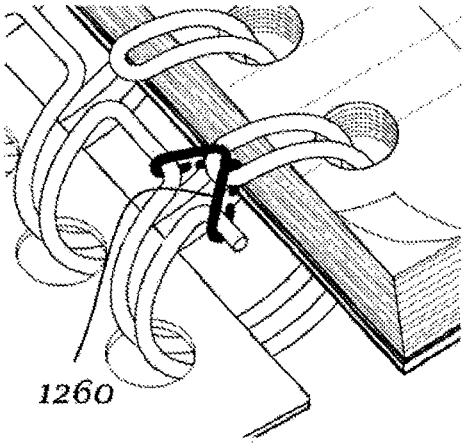

As shown in FIG. 24*c*, a pair of staples 1260, each extending from a separate joining section 170, may attached to a single tip section 160. In this case a pair of staples 1260 span across the axial gap of the binding mechanism 110 from the tip section 160 to both of the adjacent joining sections 170.

FIGS. 25*a*-25*d* show other structures and methods for locking tip sections 160 to joining sections 170 of a twin-wire binding apparatus 110. These embodiments utilize staples, locking devices or joining elements 1270 or 1280 which are more complex than the staples of the FIGS. 22, 23 and 24. The joining elements 1270/1280 can be made of the same materials outlined above for the staples. The joining elements 1270/1280 may have a generally triangular shape in top view, but can have other shapes in top view according to manufacturing preference.

Figure 25A:
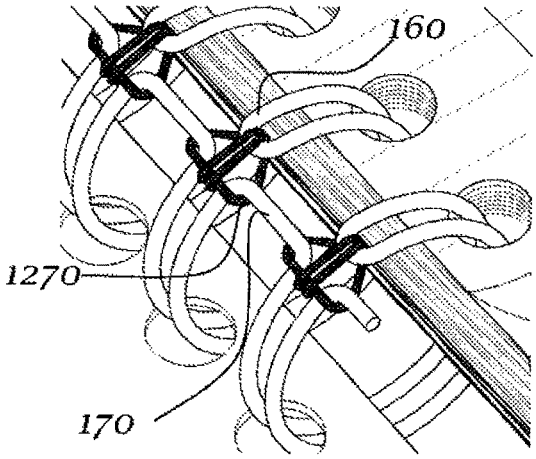
FIGS. 25*a-d* are illustrations of "staple" type devices for locking together (across the axial gap) adjacent loops of a twin-wire binding apparatus.
Figure 25B:
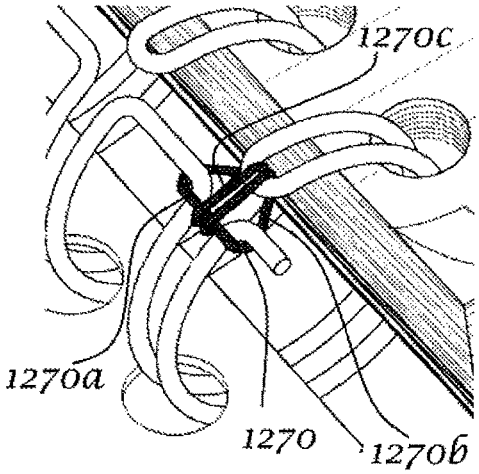

As shown in FIGS. 25*a* and 25*b*, joining element 1270 may include a base section 1270*a* which extends generally parallel to the axis 115 and connects/extends around adjacent joining sections 170. From base section 1270*a*, the joining element 1270 is bent/extends upward/circumferentially/axially as two side sections 1270*b* such that base section 1270*a* forms the base of a triangle and side sections 1270*b* form to sides of the triangle, which can be an isosceles triangle. The side sections 1270*b* pass through the loop of tip section 160 and then are bent/extend downward/circumferentially to form central sections 1270*c* which generally bifurcate the triangle. The central sections 1270*c* may have curved tips that extend around/wrap around the base section 1270*a* to secure the central sections 1270*c*/joining element 1270 in place. The joining element 1270 can be used only at the ends 116, 117 of the binding mechanism 110, along the entire length of the binding mechanism 110, or in various other arrangements thereof.

Figure 25C:
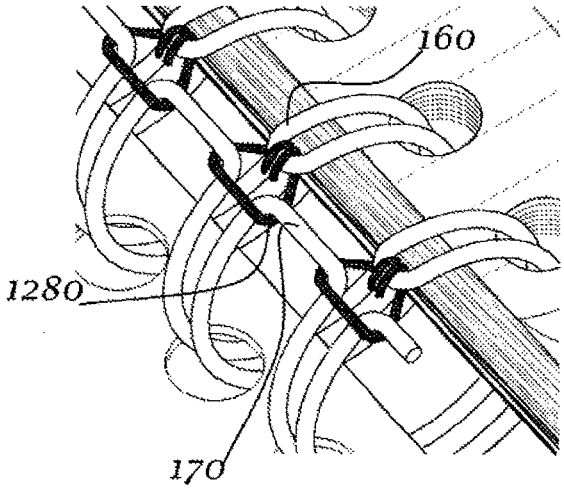
Figure 25D:
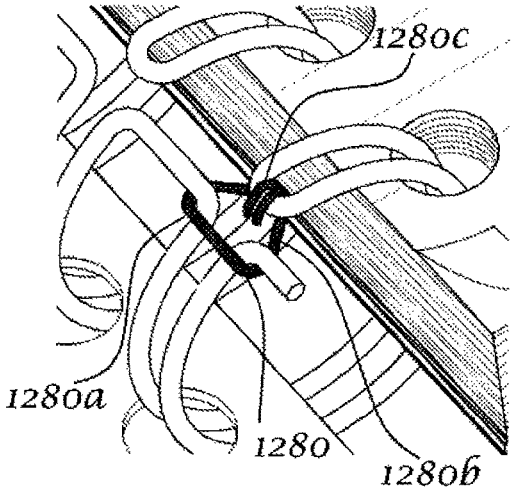

FIGS. 25*c* and 25*d* illustrate joining elements 1280 which are similar to joining elements 1270 of FIGS. 25*a* and 25*b*. In particular, the joining elements 1280 of FIGS. 25*c* and 25*d* include base sections 1280*a* and side sections 1280*b* similar to those of FIGS. 25*a* and 25*b*. However, in the embodiment of FIGS. 25*c* and 25*d* the central section 1280*c* terminates at/adjacent to the tip section 160 and is wrapped/bent about the section 160, instead of terminating at/around the base section 1280*a*. The joining element 1280 can be used only at the ends 116, 117 of the binding mechanism 110, along the entire length of the binding mechanism 110, or in various other arrangements thereof. In the embodiment shown in FIGS. 25*a*-25*d*, the joining elements/locking devices 1270/1280 couple two adjacent connection portions 170 together and to an opposed tip portion 160.

Figure 26A:
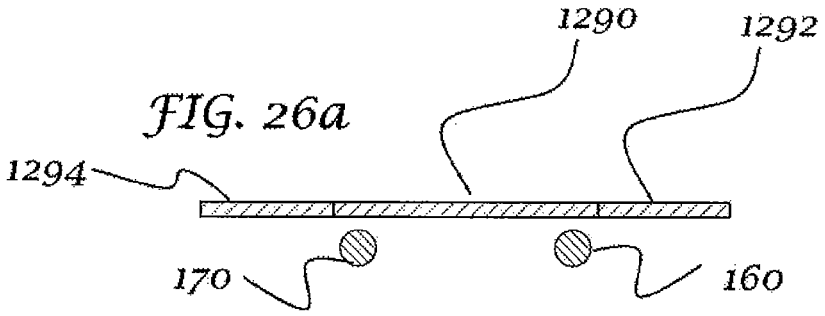
FIGS. 26*a-d* are cross sections illustrating steps for attaching a locking element to two wires of a twin-wire binding apparatus.
Figure 26B:
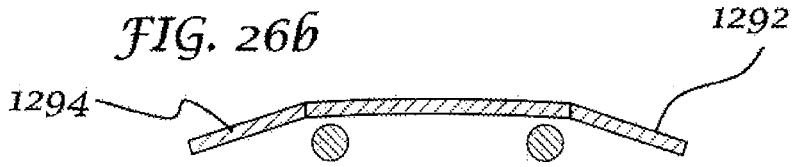
Figure 26C:
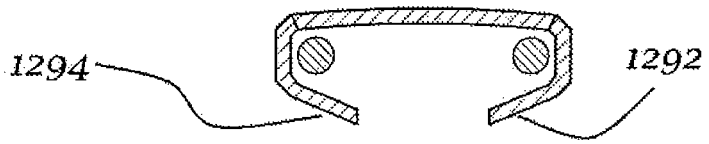
Figure 26D:
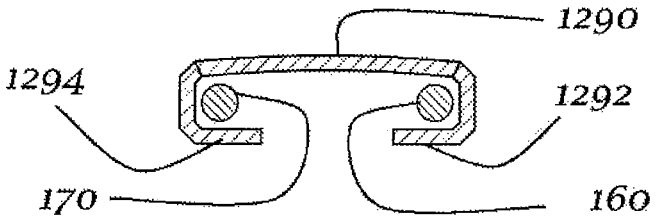

FIGS. 26*a*-*d* illustrate various steps which can be carried out to attach a staple or other joining element 1210, 1220, 1230, 1250, 1260, 1270, 1280, 1290 around the wire of a joining section 170 and/or the wire of a tip section 160. In this case the staple/joining element 1290 has ends 1292, 1294 that may initially be aligned with the spine/main body of joining element 1290, as shown in FIG. 26*a*. As shown in FIG. 26*b*, the ends or tips 1292, 1294 may then be bent slightly downward to begin forming around wires 170, 160. As shown in FIG. 26*c*, ends 1292, 1294 may be bent further, and finally as shown in FIG. 26*d*, ends 1292, 1294 may be bent to approximately 180 degrees relative to the main part of the joining element 1290, such that the ends 1292, 1294 are generally parallel to the main part 1290, to securely couple the staple/joining element to the wires 160, 170. Although the steps in FIGS. 26*a*-*d* particularly illustrate steps for forming/attaching the joining elements next shown in FIG. 27, they could also be considered to illustrate steps in making staples for example those shown in FIGS. 22*a*-*d* or other embodiments.

FIGS. 27*a*-*d* show structures and methods for locking tip sections 160 to joining sections 170 of a twin-wire binding apparatus 110 using crimp locks 1310, 1320. The crimp locks shown in FIGS. 27*a*-*d* are similar in certain respects to the spine joint 310 described previously and shown in FIGS. 7-10. The crimp locks 1310, 1320 may be made of any of the materials outlined above for the spine joint 310 or other devices disclosed herein. The crimp locks 1310, 1320 can in some cases be made from a flat strip of material, stamped out to leave fingers 1312, 1314, 1322, 1324, and then folded according to the steps shown in FIGS. 26*a*-*d*.

Depending on the resilience of the material of the crimp locks 1310, 1320, the spacing between joining sections 170 and tip sections 160, and the resilience/springiness of the binding wire used in the binding mechanism 110 forming the sections 160, 170, the crimp locks 1310, 1320 may either be completed preformed and then snapped onto/around the twin-wire binding device 110, or may be partly preformed and then crimped (e.g., deformed) onto the joining sections 170 and tip sections 160 as shown in any one of FIG. 26*a*, 26*b*, 26*c* or 26*d*.

The fingers 1312, 1322 along one edge of crimp lock 1310, 1320 may engage the loops of tip sections 160 while the fingers 1314, 1324 along the opposite edge of crimp lock 1310, 1320 may engage the joining sections 170 on the opposite side of the binding mechanism 110. The fingers may be appropriately spaced and offset from one another to fit into the tip sections 160 and joining sections 170.

Figure 27A:
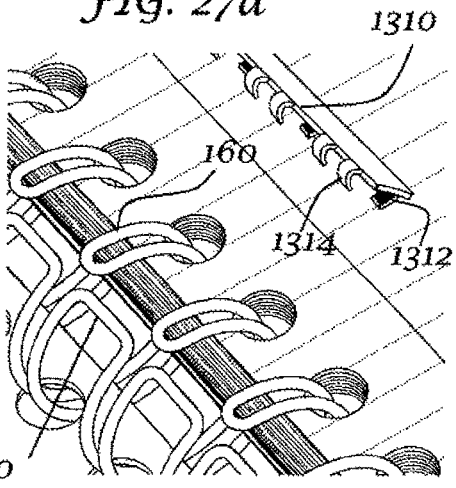
FIGS. 27 *a-d* are illustrations of "crimp" type devices for locking together (across and along the axial gap) loops of a twin-wire binding apparatus.
Figure 27B:
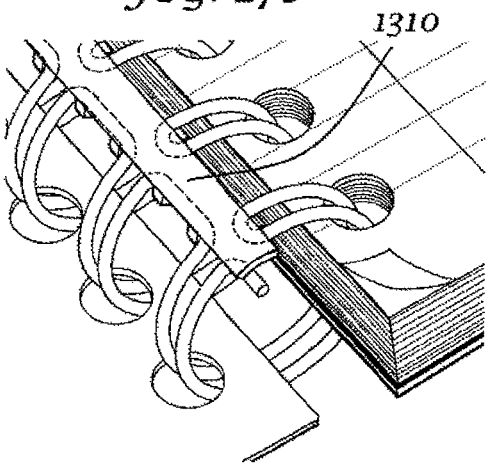
Figure 27C:
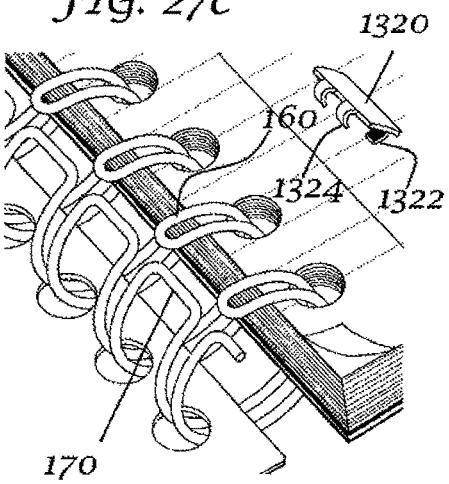
Figure 27D:
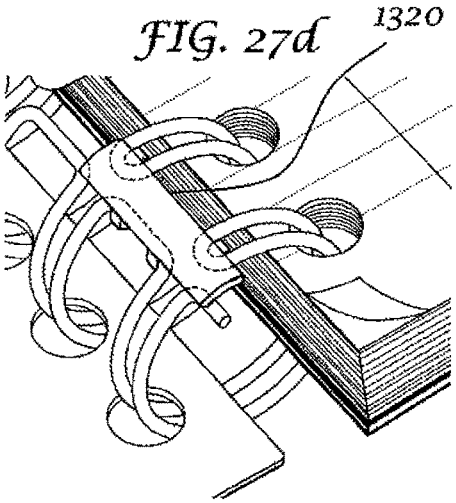
Figure 28A:
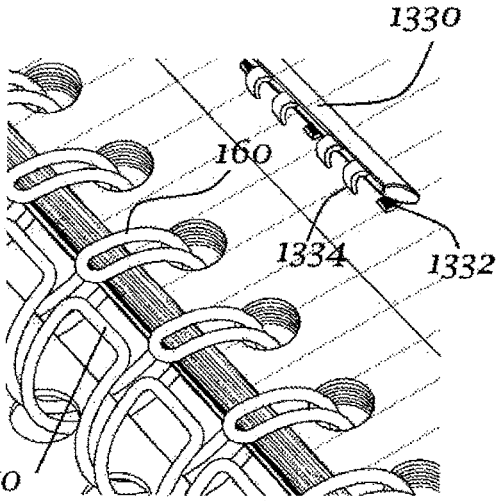
FIGS. 28*a-d* are illustrations of "crimp" type devices for locking together (across and along the axial gap) loops of a twin-wire binding apparatus.
Figure 28B:
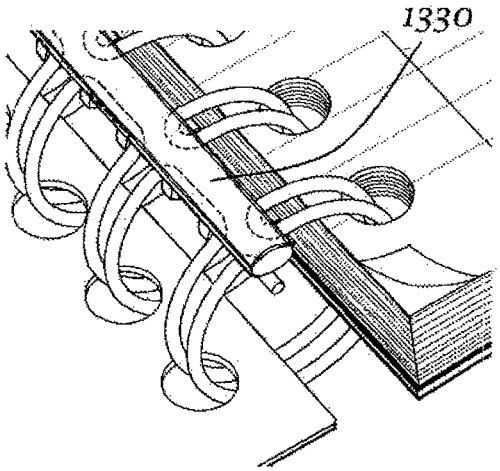
Figure 28C:
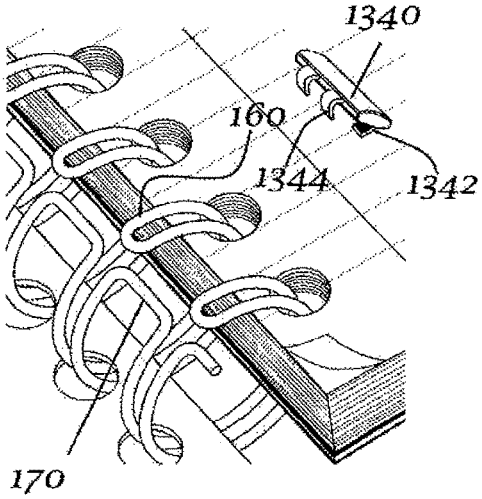
Figure 28D:
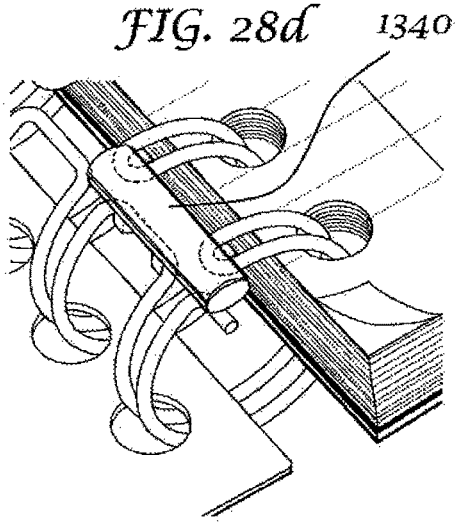

As suggested in FIGS. 27*a* and 27*b*, crimp lock 1310 may extend along the entire binding device 110, in one case engaging all or nearly all the tip sections 160 and joining sections 170. Alternately, as shown in FIG. 27*d*, crimp lock 1320 may be used only at one or both ends 116, 117 of the twin-wire binding mechanism 110. Besides being used along the entire binding mechanism 110, or at one or both ends 116, 117, crimp locks 1310, 1320 may similarly extend along any portion of the binding mechanism 110 according to manufacturing preference.

FIGS. 28*a*-*d* show structures and methods for locking tip sections 160 to joining sections 170 of a twin-wire binding apparatus 110 using crimp locks 1330, 1340. The crimp locks 1330, 1340 of FIGS. 28*a*-*d* are similar in certain respects to those described above and shown in FIGS. 27*a*-*d*. The crimp locks 1330, 1340 may be made of the same material as the crimp locks 1310, 1320 and other components described herein, and may be formed by injection molding or other forming methods. The fingers 1332, 1334 may be appropriately spaced and offset from one another to fit into the tip sections 160 and joining sections 170. The fingers 1332 along one edge of crimp lock 1330 may engage the loops of tip sections 160 while the fingers 1334 along the opposite edge of crimp lock 1330 may engage the joining sections 170. The joining element or spine of the crimp locks 1330, 1340 of FIGS. 28*a*-*d* may be thicker and more defined than those of FIGS. 27*a*-*d*.

FIGS. 29*a*-*f* show structures and methods for joining locking tip sections 160 together using "guardrail" locks 1350, 1360, and 1370. The guardrail locks 1350, 1360, and 1370 may be made of the same materials of the various other components described herein, including the spine joint 310, and can be formed by injection molding, stamping, or other forming method. As shown in FIG. 29*a*, guardrail lock 1350 may have narrow or elongated loop shape in front view having a pair of opposed longitudinal pairs or rails. The lock 1350 may have a plurality of inwardly-extending fingers 1352, positioned along one rail/side thereof, and another plurality of inwardly-extending fingers 1353 positioned along another rail/side thereof. Each of the fingers 1352, 1353 may extend inwardly about one-half, or less than one-half, the height of the gap in the guardrail lock 1350.

The guardrail lock 1350 is sufficiently long to extend around one or more pairs of tip wires 160, with one or more fingers 1352 fitting into the center of a tip section 160. The fingers 1353 are positioned such that one or more fingers 1353 fit around the outside of tip section(s) 160 such that each wire section of a tip section 160 is trapped between a pair of fingers 1353, 1352.

Figure 30:
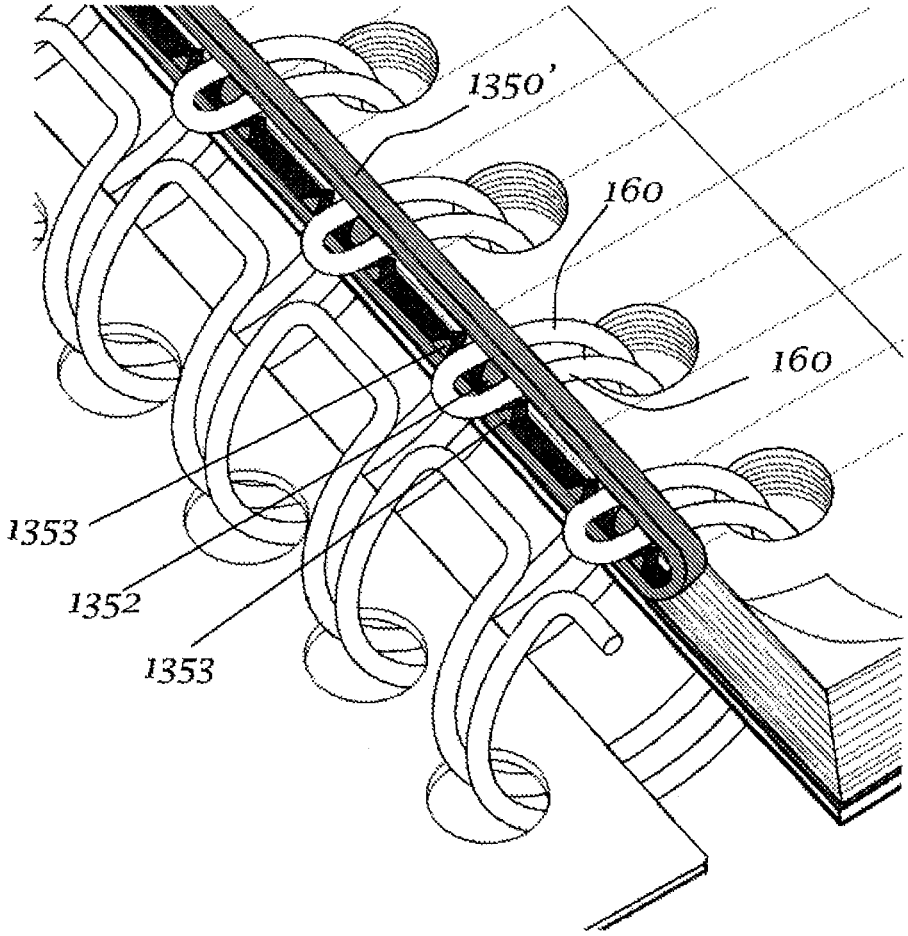
FIG. 30 is an illustration of an installed "guard rail" type element for locking together (along the binding axis) loops of a twin-wire binding apparatus.

The guardrail lock 1350 can be utilized by placing the guardrail lock 1350 into the axially-extending gap of the binding mechanism 110, and then moving the guardrail lock 1350 circumferentially until the guardrail lock 1350 engages the tip sections 160, as shown in FIG. 29*a* and FIG. 30. After the guardrail lock 1350 is placed over the ends of tip sections 160, the guardrail lock 1350 may be pressed together, squeezing the rails toward each other, to form closed guardrail lock 1350' which sandwiches the tip sections 160 between the rails of the guardrail lock (see FIG. 29*b*). The guardrail lock 1350 may be compressed until the tips 1352, 1353 engage the opposite rail. The tips 1352, 1353 may be sized and configured to grip the tip sections 160 by frictional forces, and/or cause the tip sections 160 to spring apart and grip the tip sections 1352 therebetween by spring force.

The guardrail lock 1350 may be configured to be manually movable between its unlocked (FIG. 29*a*) and locked (FIG. 29*b*) positions to allow users to mount and/or dismount the guardrail lock 1350 to various binding mechanisms. Alternately, the guardrail lock 1350 has sufficient stiffness and/or sufficient locking forces are required that the guardrail lock 1350 cannot be manually moved between either the locked or unlocked positions.

In one case, the guardrail lock 1350' may extend along the entire binding apparatus 110, engaging all or nearly all the tip sections 160. Alternately, guardrail lock 1350' may be used only at one or both ends of the twin-wire binding mechanism 110, or may extend along any portion of the binding mechanism 110 according to manufacturing preference.

FIGS. 29*c* and 29*d* shows a guardrail lock 1360 in the form of a narrow loop long enough to extend around one or more pairs of tip wires 160, with one or more fingers configured 1362, 1363 to fit into the center of a tip section 160. In this embodiment, when the guardrail lock 1360 is moved to its locked position (FIG. 29*d*) the guardrail lock 1360' sandwiches the tip sections 160 between the rails of the guardrail lock 1360'. The fingers 1362, 1363 may meet together as shown, or may be spaced apart, when the guardrail lock 1360' is compressed.

FIGS. 29*e* and 29*f* shows another guardrail lock 1370 in the form of a narrow loop long enough to extend around one or more pairs of tip wires 160. After placing guardrail lock 1370 over the ends of tip sections 160, the longitudinal sides/rails 1372, 1373 of the guardrail lock may be pressed together to form closed guardrail lock 1370' shown in FIG. 29*f* which sandwiches the tip sections 160 between the longitudinal sides 1372, 1373 of the guardrail lock 1370'. In the embodiment of FIGS. 29*e* and 29*f*, the longitudinal side 1372 is deformed inwardly in the area between pairs of tip sections 160, and the longitudinal side 1373 is deformed inwardly into the gap of a tip section 160. A forming tool (not shown) may be used to deform the closed guardrail lock 1370' to a desired shape. FIG. 30 shows a detail illustration of closed guardrail lock 1350' installed on a twin-wire binding apparatus 110 with the long sides of the guardrail lock 1350' closed about the tip sections 160, with fingers 1352 inside the tip section 160 and fingers 1353 just outside the tip section 160.

FIGS. 31*a-c* show a lock or locking device 1380 configured to be coupled on the ends of tip section 160. The lock 1380 may be formed (for example by injection molding) with an upper portion 1385 and lower portion 1386 pivotally joined together joined by hinge 1384. In one case the hinge 1384 is made of a thinner and/or weaker material than the upper 1385 and lower 1386 portions to provide the hinge functionality. The lock 1380 may have one or more axially-extending wing sections 1382 extend axially beyond the edges of the holes 140 serve to ensure that the papers 150 or other contents are retained in the binding mechanism 110. Protrusions 1387 may be positioned on the lower surface of upper portion 1385 and/or the upper surface of lower portion 1386, which protrusions 1387 are configured to fit inside or around the wires of tip section 160.

In order to mount the lock 1380 in place the lock 1380 is positioned as shown in FIG. 31*b*. The upper portion 1385 and/or lower portion 1386 are the folded together about hinge 1384 onto tip section 160 as shown in FIG. 31*c*. The upper 1385 and lower 1386 portions may then be coupled together by interlocking parts such as a snap-fit (not shown), by ultrasonic welding or heat welding, or by adhesive, or the molded lock 1380 may be applied while warm and pliable, and allowed to cool so that the hinge portion 1384 becomes sufficiently stiff to hold the molded lock 1380 in place.

The lock 1380 (and other locks disclosed below, for example, in FIGS. 31 and 32) may be configured to be manually movable between the locked and unlocked positions to allow users to couple and/or decouple the lock 1380 to various binding mechanisms. Alternate, the lock may not be manually movable to provide greater security. As shown in FIG. 31*a*, molded lock 1380' (as well as the locks described below, for example, in FIGS. 31 and 32) may be applied to a single tip section 160, for example at one or both ends 116, 117 of the twin-wire binding apparatus 110, or may be applied elsewhere along the length of the binding apparatus 110. The molded lock 1380' (as well as the locks described below, for example, in FIGS. 31 and 32) may cover only a single tip section 160, or may extend over multiple tip sections (not shown).

FIGS. 31*d-f* show a lock/locking device 1390 as a snap-on component with grooves 1393 to receive one or both of the wires of tip section 160. Each groove 1393 may be sized to closely receive a wire of the tip section 160 therein, and may have a bottom opening that is smaller than the diameter of the wire such that the bottom opening/groove 1393/lock 1390 is deformed to receive the wire of the tip section 160, and then returns to its original undeformed shape to retain the tip section 160 therein. However, in some cases the bottom opening is not smaller than the diameter of the wire of the tip sections 160 such that the lock 1390 can be easily placed onto the tip section 160. The lock 1390 may include a center protrusion 1397 positioned between the grooves 1393 and configured to fit between the wires of tip section 160. The lock 1390 may also include one or more axially extending wing sections 1392, extending axially past the associated openings 140 to prevent papers 150 or other components from separating from the binding mechanism 110.

In order to use the lock 1390 it is first snapped or positioned into place on a tip section(s) 160, as shown in FIG. 31*e*. A forming tool 1398 (FIG. 31*f*) may be pressed against/into molded lock 1390, for example into protrusion 1397. The forming tool 1398 can be applied either with or without heating of the tool 1398 and/or protrusion 1397. The tool 1398 is pushed into the protrusion, as shown in FIG. 31*f*, thereby displacing material sideways under/into the grooves 1393 and wires of the tip sections 160, locking the lock 1390 in place.

Figure 32A:
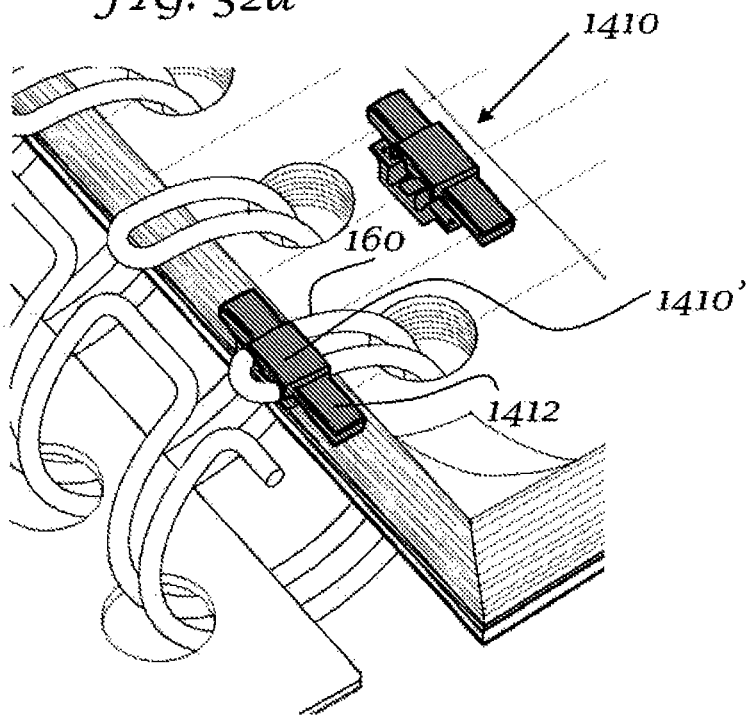
FIGS. 32*a-b* are illustrations of another element for attaching to the tips of loops of a twin-wire binding apparatus.
Figure 32B:
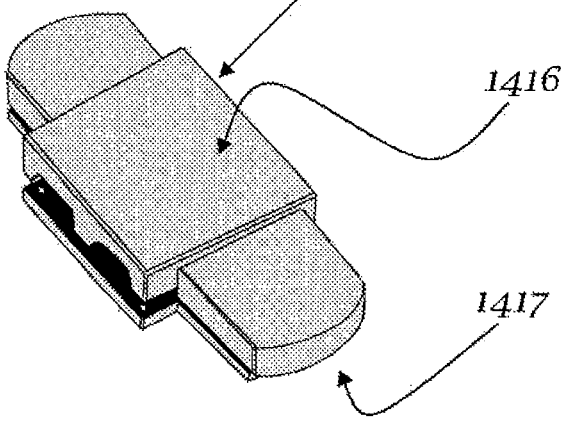

FIGS. 32*a* and 32*b* show a two piece lock 1410 configured to fit on the ends of tip section 160. The two piece molded lock 1410 may be formed (for example by injection molding) as a snap-on component including two separate parts 1416, 1417. One part 1416/1417 is configured to be positioned on a first (upper) side of the associated coil tip 160, and the other part 1417 is configured to be positioned on a second (lower) side of the tip 160. Each part 1416, 1417 may include a center protrusion configured to be positioned in the loop of a tip 160.

The parts 1416/1417 may have complementary features such as snap-together features, or other interconnecting features (not shown) to hold the two parts 1416, 1417 together when mounted onto a top 160. Alternately, or additionally, adhesive, ultrasonic welding, and/or heat welding may be used to hold the two parts 1416, 1417 together. The lock 1410 and/or one or both parts 1416/1417 may include one or more axially-extending wing sections 1412 that serve to block papers 150 or other contents from coming off the tip section 160.

Figure 33A:
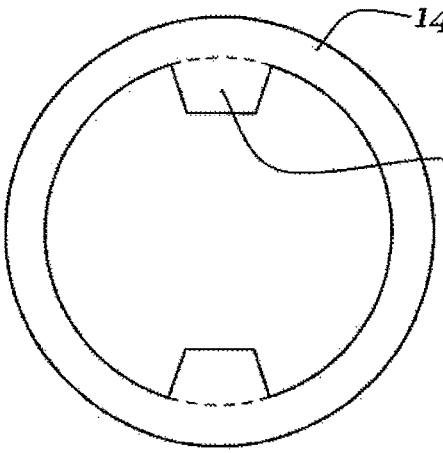
FIGS. 33*a-f* are illustrations of washer-type elements for attaching to the tips of loops of a twin-wire binding apparatus.
Figure 33B:
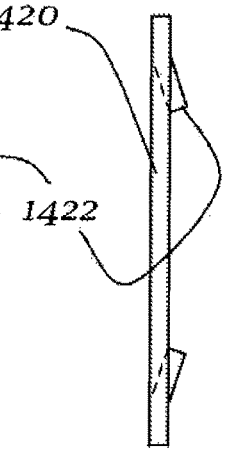

FIGS. 33*a-d* illustrate another locking device for retaining components on the binding mechanism 110 in the form of a crimpable or deformable washer lock 1420 that can be deformed and fit on the ends of tip section 160. The washer lock 1420 may be formed from metal, polymers or plastic (for example by stamping or injection molding) or materials for the other devices disclosed herein, including the spine joint 310. The washer lock 1420 may be generally annular/circular in front/top view, as shown in FIG. 33*a*, but could also have or be in other shapes besides circular, with a central opening formed therein. The washer lock 1420 may include one or more protrusions/teeth 1422 that extend radially inwardly into the central opening. When initially formed, the washer lock 1420 may be generally flat and planar, except that the teeth 1422 may be slightly out of plane as shown in side view in FIG. 33*b*. If desired, however, the teeth 1422 may also be flat and planar.

Figure 33C:
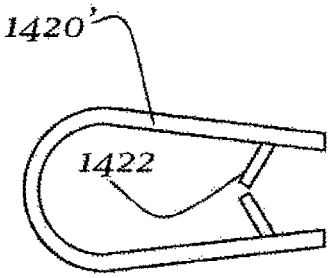

In order to use the washer lock 1420 it may be placed over the end of tip section 160 and bent over on itself approximately 180 degrees over the tip section 160, forming the washer lock 1420 into an approximately into a "C" shape in side view (FIG. 33*c*) or semicircular shape in top view. When the washer lock 1420 is deformed in this manner, the teeth 1422 engage each other or are positioned close to each other, thereby locking the teeth 1422 into the loop of the associated tip section 160. The angled nature of the teeth 1422 helps to ensure that the teeth 1422 are further defected when the washer lock 1420 is bent to avoid having the teeth 1422 directly engage each other and provide undue resistance to the deflection of the washer lock 1420. When the washer lock 1420 is deformed, it may include an upper portion and a lower portion generally aligned with the upper portion (as best shown in FIG. 33*c*), wherein the upper and lower portions are separated by a fold line or folded area extending generally parallel to the axis of the binding apparatus 110.

Figure 33D:
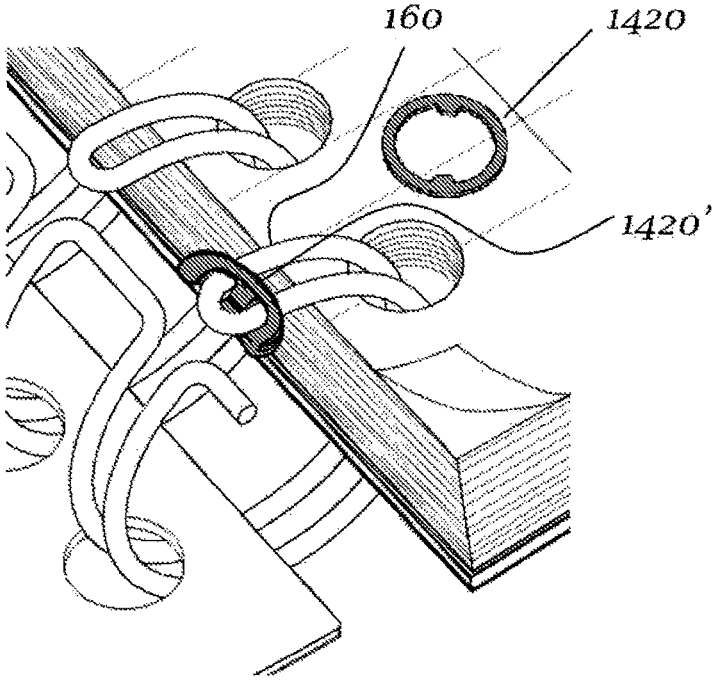

As shown in FIG. 33*d*, the portions of the washer lock 1420 extending parallel to the axis 115 extend beyond the openings 140 in the papers 150 or other components. In this manner the washer lock 1420 is securely coupled to the tip section 160 and effectively widens the end of tip section 160 to prevent contents from coming off tip section 160.

As shown in FIG. 33*d*, bent washer lock 1420' (as well as the other embodiments shown in FIGS. 33, 34 and 35) may be applied to a single tip section 160, for example at one or both ends 116, 117 of the twin-wire binding apparatus 110, or it may be applied to one or more tip sections 160 elsewhere along the length of the binding apparatus 110, or across multiple tip sections 160.

Figure 33E:
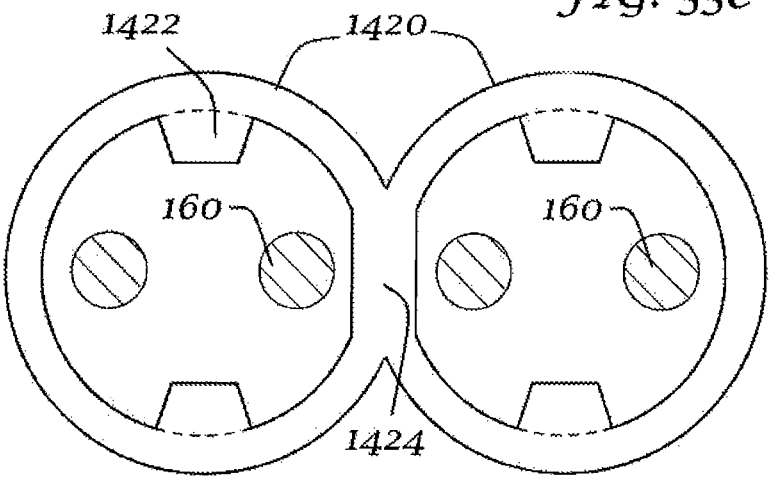

FIG. 33*e* shows an un-deformed washer lock including two sections 1420 joined by a relatively short bridge 1424. The device shown in FIG. 33*e* may be used on two adjacent tip sections 160 and be utilized generally in the manner shown in FIGS. 33*a-d* and described above. The washer locks may also include more than two sections 1420 to join more than two adjoining tip sections 160 as desired.

Figure 33F:
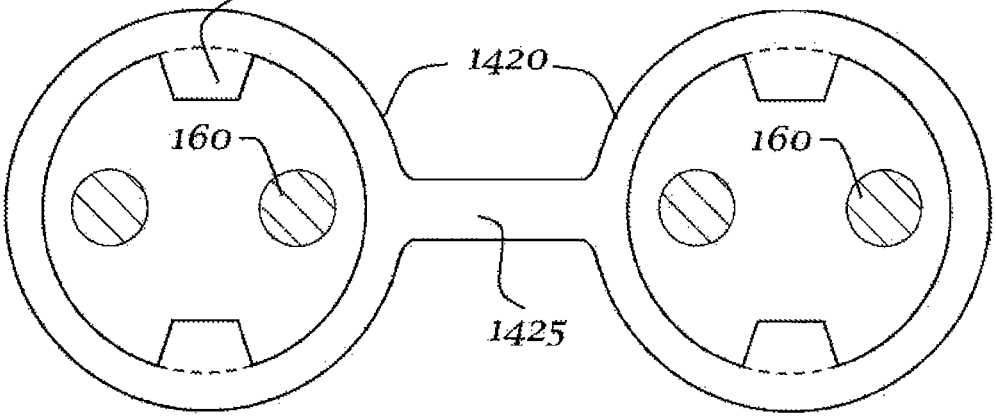

FIG. 33*f* shows a washer lock including two sections 1420 joined by a longer bridge 1425 compared to that of FIG. 33*e*. This configuration may be used in conjunction with a binding mechanism having adjacent tip sections 160 which are spaced further apart, or used in conjunction with non-adjacent tip sections 160. The washer lock of FIG. 33*f* can include more than two sections 1420 to join more than two tip sections 160 as desired.

Figure 34A:
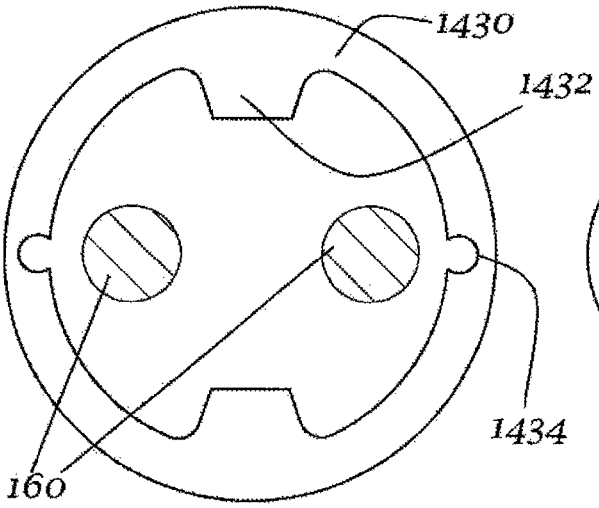
FIGS. 34*a-e* are illustrations of other washer-type elements for attaching to the tips of loops of a twin-wire binding apparatus.
Figure 34B:
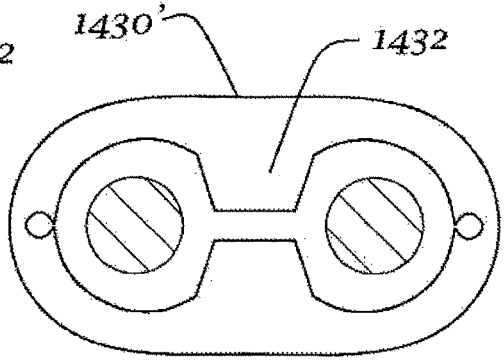
Figure 34C:
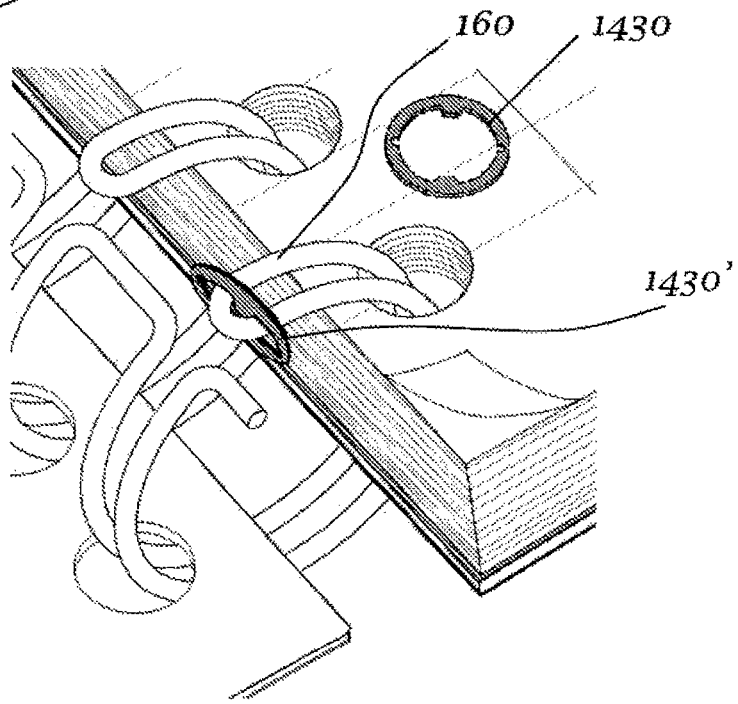

FIGS. 34*a-c* show a crimpable washer lock 1430 configured to fit on the ends of tip section 160. The crimpable washer lock 1430 may be similar in shape, materials and structure to the washer lock 1420 shown in FIGS. 33*a*-33*d*, including one or more teeth 1432. The washer lock 1430 of FIG. 34 may include a relief opening 1434 positioned at one or more locations on the washer lock 1430 to enable the washer lock 1430 to deform more easily or with more control during crimping. The relief openings 1434 may be 180 degrees opposite each other, and offset about 90 degrees from the teeth 1432.

In order to use the crimpable washer lock 1430 of FIG. 34*a*, the washer lock 1430 may be placed over the end of tip section 160 and then be compressed or crimped generally within the plane of the washer lock 1430 of the washer lock 1430 (for example by applying compressing forces to the washer lock 1430 in the radial direction). When the washer lock 1430 is compressed in this manner, the washer lock 1430 is moved to an elongate shape and the teeth 1432 approach each other and enter the loop in a tip section 160, thereby gripping tip section 160 and effectively widening the end of tip section 160 to prevent contents from coming off tip section 160.

Figure 34D:
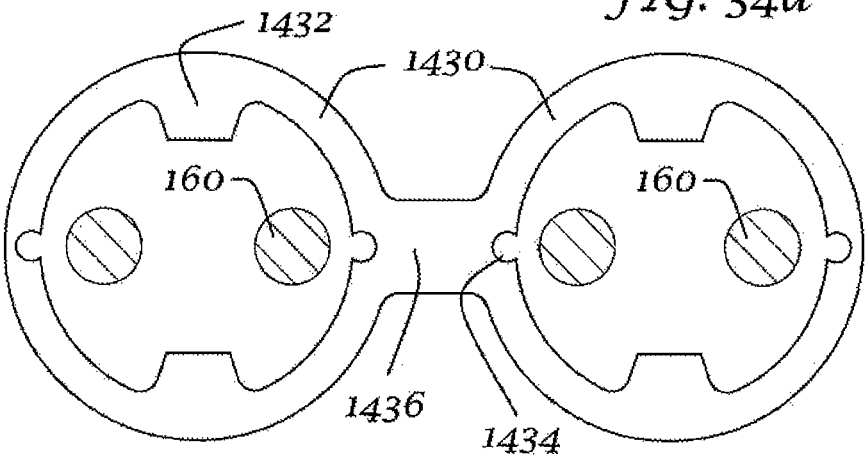
Figure 34E:
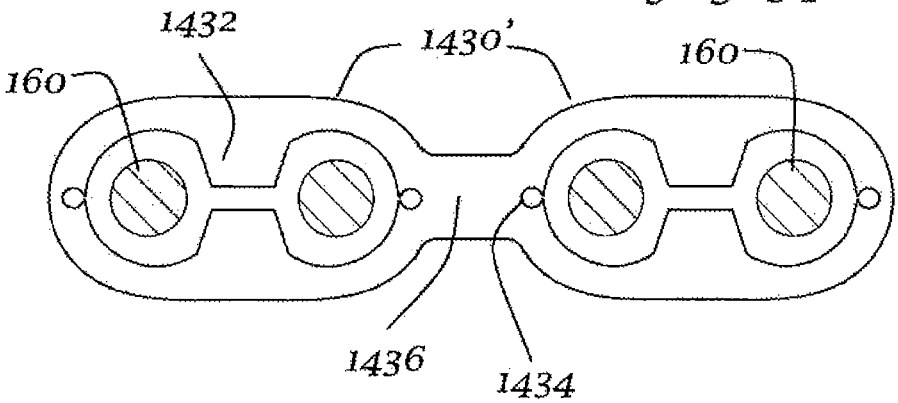

FIG. 34*d* shows a crimpable washer lock similar to that of FIGS. 34*a-c* but including two sections 1430 joined by bridge 1436 and suitable for use on two tip sections 160. FIG. 34*e* shows the washer lock after crimping. The crimpable washer lock may include more than two sections 1430 as desired.

Figure 35A:
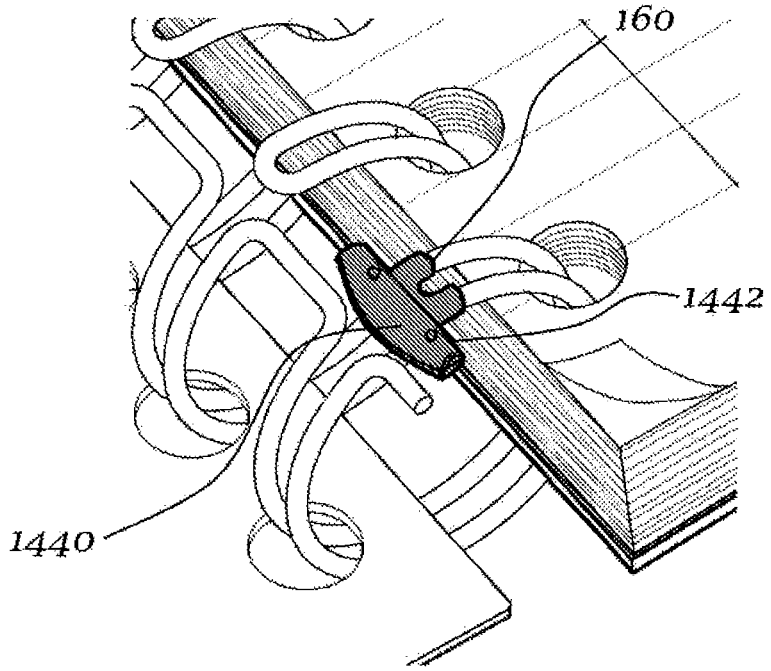
FIGS. 35*a-b* are illustrations and cross sections of an in-place elements for attaching to the tips of loops of a twin-wire binding apparatus.
Figure 35B:
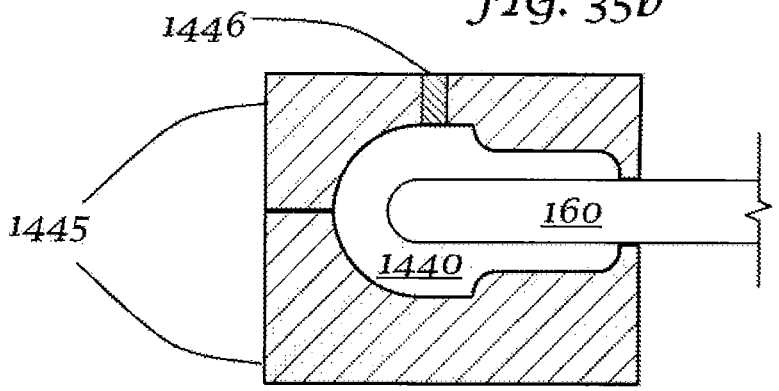

FIGS. 35*a* and 35*b* show a lock 1440 configured to fit on the ends of tip section 160. The molded lock 1440 may be formed from plastic, polymers, metal, or other materials described herein for the other devices disclosed herein (for example by injection molding). The lock 1440 can have a variety of shapes or forms, including the exemplary form shown in FIG. 35*a* and may have one or more axially-extending wings 1442 to ensure contents remain on the binding mechanism 110.

As shown in the cross section of FIG. 35*b*, molded lock 1440 may be formed by placing a mold 1445 over a one or more tip sections 160 and injecting an injectable material (such as thermoplastic material, polymers, plastic or metal) in a fluid state through one or more sprues 1446 of the mold 1445 to form a molded lock 1440 around the tip section 160. The mold 1445 is then removed, leaving the molded lock 1440 behind to cool, harden, cure or dry. The molded lock 1440 may be located at one or both ends of the twin-wire binding apparatus 110, or it may positioned on one or more tip sections 160 elsewhere along the binding apparatus 110.

FIGS. 36*a-e* show pre-formed terminal or protruding portions 1450 on the tip sections 160 of a twin-wire binding apparatus 110. The tip sections 160 may each have content-carrying or storage section 161 made of two generally parallel wire segments spaced together closely enough to pass through the holes in the papers 150 or other content, or having a total thickness less than the diameter of the holes 140. In contrast, the pre-formed terminal portions 1450 may be wider, in the axially-extending direction and in an undeformed/natural state, than the holes 140 in the content, or than content-carrying sections 161.

Figure 36A:
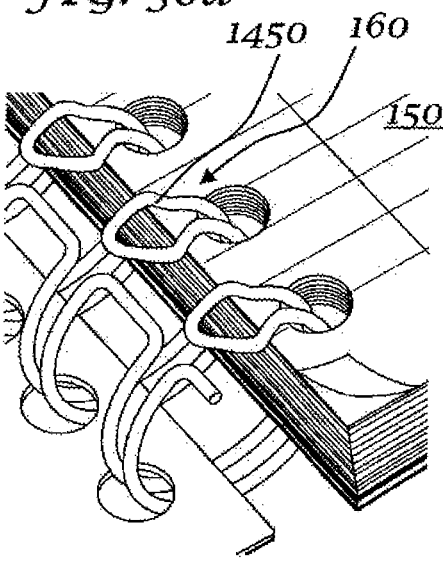
FIGS. 36*a-e* are illustrations of tips on the loops of a twin-wire binding apparatus for securing the bound components in place.
Figure 36B:
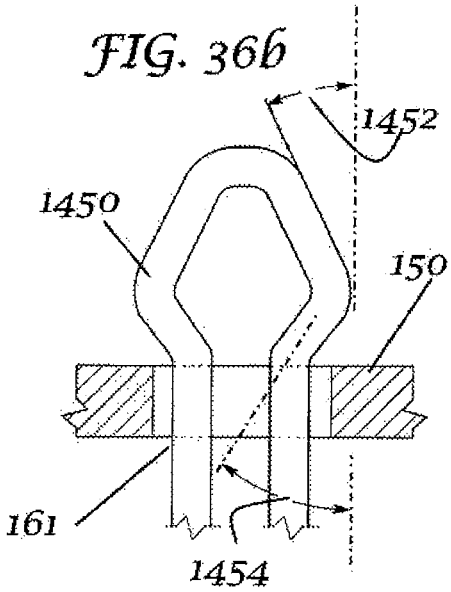
Figures 37A, 37B, 37C, 37D, 37E:
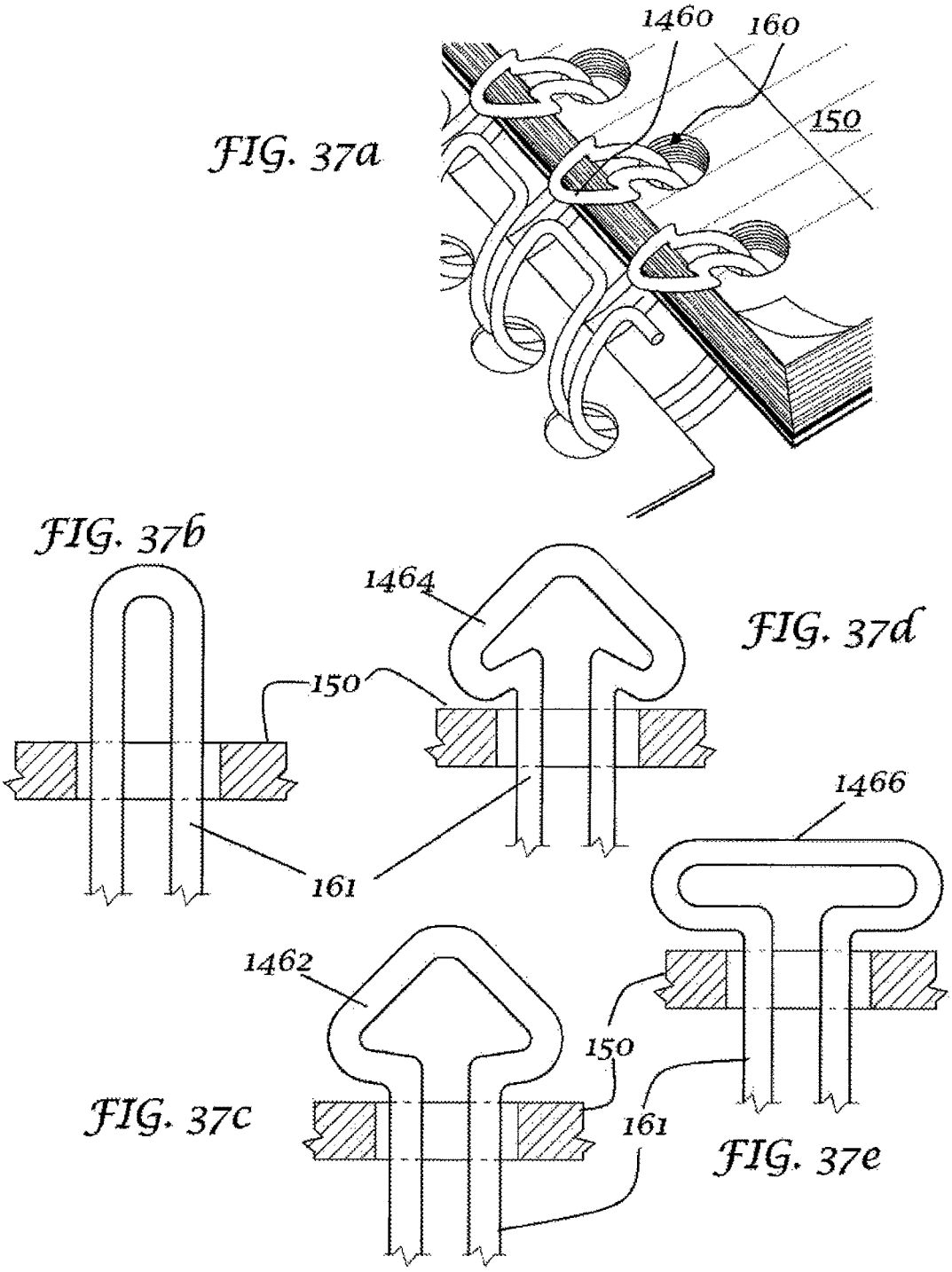
FIG. 37*a* is an illustration of tips on the loops of a twin-wire binding apparatus for securing the bound components in place.
FIG. 37*b* is side view of a tip on a loop of a twin-wire binding apparatus.
FIGS. 37*c-e* are side of view of the tip of FIG. 37*b* formed into various shapes for securing the bound components in place.

As shown in FIG. 36*b*, pre-formed terminal portions 1450 may be formed with a terminal angle or leading edge 1452 (at the end of the pre-formed tip 160) and a transitional angle or trailing edge 1454 (leading back into the main part of tip 160). The terminal angle 1452 may be more acute than the transitional angle 1454. For example terminal angle 1452 may be relatively acute so that the tip 160 is relatively easily inserted into the papers 150 or other content, but resists removal therefrom. In one case the terminal angle 1452 may be in the range of about 10 to about 45 degrees (relative to a radial plane or circumferential line) and transitional angle 1454 is in the range of about 30 to about 120 degrees, such as depicted in FIG. 37*d*. However it should be understood that these angles and ranges of angles provided herein are only meant as examples and not as limiting ranges. A more acute terminal angle 1452 may make it easier for the pre-formed terminal portion 1450 to pass through the hole in contents 150, while a less acute transitional angle 1454 may make it more difficult for the contents 150 to escape from the tip section 160. The terminal portion 1450 may have an axial width greater than an axial width of any other portion of the binding coil.

Figure 36C:
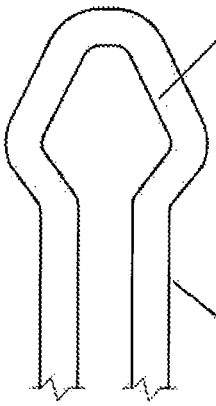
Figure 36D:
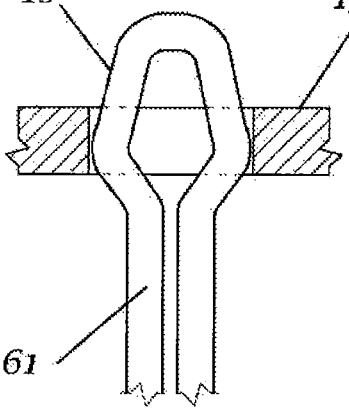
Figure 36E:
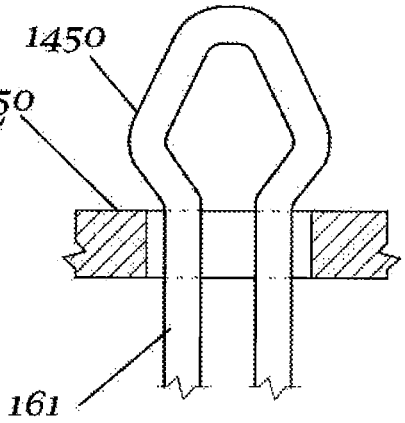

FIGS. 36*c-e* illustrate a sequence showing a tip section 160 being inserted into the contents 150. FIG. 36*c* shows the tip section 160 with pre-formed terminal portion 1450 in an undeformed/natural state. FIG. 36*d* shows the leading edge 1450 engaging the content items 150 and being compressed together. The content-carrying section 161 may also be compressed together. The tip section 160 may be sufficiently deformable that inserting the tip section 160 into the aligned openings 140 causes deflection of the tip sections 160 during insertion. Alternately, in some cases the tip sections 160 may be squeezed together by outside forces during insertion. FIG. 36*e* shows the tip section 160 and pre-formed terminal portion 1450 after they have sprung back to their natural/undeformed configuration which now securely holds papers 150 and other content on the tip section 160.

FIGS. 37*a-e* show terminal portions 1460 on the tip sections 160 of a twin-wire binding apparatus 110 which operate similar to, and can provide the same benefits as, the embodiments described above and shown in FIG. 36. Alternately, the tip sections shown in FIG. 37 (and/or FIG. 36) can be formed into the desired shape after the tip sections 160 are passed through the holes 140 of the papers 150 and other content items. For example the tip sections 160 may initially have the shape shown in FIG. 37*b* as the tip sections 160 are passed through the holes 140 of the papers 150 and other content items. After the tip sections 160 are fully passed through the holes 140, the tip sections 160 can then be formed into the shapes shown in FIGS. 37*a* and 37*c-e*, FIG. 36 or other shapes. The tip sections can be shaped by mechanical robotic pinching forming fingers, or other forming device that can reach in and form the tip sections 160 after inserting through the pages 150. The post-formed terminal portions 1460 may be made larger than the content-carrying sections 161, and/or longer than the holes 140 to prevent or limit pages 150 from coming off the tip sections 160.

FIG. 37*c* shows a post-formed terminal portion 1462 with a triangular or arrow shape, formed after the tip 160 has passed through the hole in content 150. FIG. 37*d* shows another "arrow" shaped post-formed terminal portion 1464, and FIG. 36*e* shows a t-shaped post-formed terminal portion 1466. Other shapes may also be used provided they extend or widen the end of tip section 160 sufficiently to prevent or discourage content 150 from coming off the tip section 160.

It should be understood that the method and structures described herein for locking the twin-wire or spiral bindings may be used in combination with each other. For example a solder weld may be used at each end of the binding with a comb-lock attached at one or more locations between the ends. As another example, metal coil spine joints may be used at the ends of the binding, with plastic coil spine joints used at one or more points between the ends. Various other combinations are also possible.

This disclosure should not be read as being limited only to the foregoing examples or only to the designated preferred embodiments.

What is claimed is:

1. A binding apparatus system comprising:

a binding apparatus including a plurality of coaxially arranged binding coils, each binding coil including a pair of parallel wires terminating in a tip, each binding coil being coupled to an adjacent binding coil by a connection portion extending parallel to an axis of the binding apparatus and at least partially axially offset from each tip; and a locking device extending at least partially circumferentially and coupling portions of the binding apparatus, the locking device including a spine oriented parallel with the axis of the binding apparatus, the locking device further including at least two hook portions coupled to the spine on opposite sides of the spine, each hook portion lockingly engaging a portion of the binding apparatus.

2. The binding apparatus system of claim 1 wherein the binding apparatus includes an axially extending gap, and wherein the locking device circumferentially extends across the gap.

3. The binding apparatus system of claim 1 wherein each tip has an axial length less than an axial length of an adjacent connecting portion, and wherein each tip is axially offset from each connecting portion.

4. The binding apparatus system of claim 1 wherein each hook portion wraps at least partially around a portion of said binding apparatus.

5. The binding apparatus of claim 1 wherein each hook is axially aligned with another hook of said locking device.

6. The binding apparatus of claim 1 wherein each hook is axially offset from and does not axially overlap with any other hook of said locking device.

7. The binding apparatus of claim 1 wherein the locking device has an axial length less than a combined axial length of a connection portion and a tip portion.

8. The binding apparatus of claim 1 wherein the locking device has no more than three hook portions.

9. The binding apparatus system of claim 1 wherein the binding apparatus is made of a single continuous wire, and wherein the locking device is made of a different piece of material than the binding apparatus.

10. The binding apparatus system of claim 1 wherein the locking device is coupled, at one circumferential end, to a binding coil at or adjacent to the tip of the spine, wherein the locking device is coupled, at the other circumferential end, to one of said connection portions.

11. The binding apparatus system of claim 1 wherein said locking device circumferentially couples two adjacent connection portions together and to an opposed tip portion.

12. The binding apparatus system of claim 1 wherein the locking device has a pair of opposed circumferential ends, and each end is directly mechanically coupled to the binding apparatus.

13. The binding apparatus system of claim 1 wherein said locking device extends circumferentially less than 360 degrees.

14. The binding apparatus system of claim 1 wherein locking device is the only component circumferentially coupling portions of the binding apparatus at an axial position of said locking device.

15. The binding apparatus system of claim 1 wherein an entirety of said binding apparatus is made of a single wire component formed in a cylindrical shape.

16. The system of claim 1 wherein each hook portion extends outwardly from said spine in a direction perpendicular to the spine.

17. The system of claim 1 wherein each hook portion extends outwardly from said spine in a direction perpendicular to the spine.

18. The system of claim 1 wherein the spine is oriented parallel with the axis of the binding apparatus.

19. The system of claim 1 wherein a free, distal end of each hook portion is oriented perpendicular to the spine.

20. A binding apparatus system comprising:

a binding apparatus including a plurality of coaxially arranged binding coils, each binding coil including a pair of parallel wires terminating in a tip, each binding coil being coupled to an adjacent binding coil by a connection portion extending parallel to an axis of the binding apparatus and at least partially axially offset from each tip; and a locking device extending at least partially circumferentially and coupling portions of the binding apparatus, the locking device including a spine oriented parallel with the axis of the binding apparatus, the locking device further including at least two hook portions coupled to the spine on opposite sides of the spine, each hook portion lockingly engaging a portion of the binding apparatus, wherein each hook portion is permanently and non-removably coupled to the binding apparatus.

21. A binding apparatus system comprising:

a locking device configured to couple portions of a wire binding apparatus at least partially in a circumferential direction, the locking device including a spine configured to be oriented parallel with an axis of the binding apparatus, the locking device further including at least two hook portions coupled to the spine on opposite sides of the spine and extending outwardly from said spine in a direction perpendicular to the spine, each hook portion being configured to lockingly engaging a portion of the binding apparatus, wherein said hook portions are least partially axially offset.

22. The binding apparatus system of claim 21 further comprising said wire binding apparatus including a plurality of coaxially arranged binding coils, each binding coil including a pair of parallel wires terminating in a tip, each binding coil being coupled to an adjacent binding coil by a connection portion extending parallel to an axis of the binding apparatus.

23. The binding apparatus system of claim 22 wherein said connection portion is at least partially axially offset from each tip.

24. The system of claim 21 wherein each hook portion has a curved inner surface configured to receive a portion of the wire binding apparatus therein, and wherein the curved inner surface curves about a center axis that is parallel to the spine.

25. The system of claim 22 wherein the spine is oriented parallel with the axis of the binding apparatus.

26. A method for forming a binding apparatus system comprising:

providing a binding apparatus including a plurality of coaxially arranged binding coils, each binding coil including a pair of parallel wires terminating in a tip, each binding coil being coupled to an adjacent binding coil by a connection portion extending parallel to an axis of the binding apparatus and at least partially axially offset from each tip;

providing a locking device including a spine and at least two hook portions coupled to the spine on opposite sides of the spine; and coupling said locking device to said binding apparatus such that the locking device couples portions of the binding apparatus at least partially in a circumferential direction, said spine is arranged parallel to said axis, and such that each hook portion lockingly engages a portion of the binding apparatus.

* * * * *